US005748210A

United States Patent [19]

Watanabe et al.

[11] Patent Number: 5,748,210

[45] Date of Patent: May 5, 1998

[54] INK JET TYPE RECORDING UNIT WITH AN IMPROVED CARRIAGE STRUCTURE

[75] Inventors: Kohji Watanabe; Satoshi Fujioka; Fujio Akahane; Yoshikatsu Yamamoto; Susumu Murayama; Takayuki Okuda; Masanori Yoshida; Atsushi Nishizawa, all of Nagano, Japan

[73] Assignee: Seiko Epson Corporation, Tokyo, Japan

[21] Appl. No.: 552,520

[22] Filed: Nov. 2, 1995

[30] Foreign Application Priority Data

| | | | |
|---|---|---|---|
| Nov. 2, 1994 | [JP] | Japan | 6-293908 |
| Jan. 23, 1995 | [JP] | Japan | 7-027329 |
| May 24, 1995 | [JP] | Japan | 7-149643 |

[51] Int. Cl.[6] ..... B41J 2/14; B41J 2/16

[52] U.S. Cl. ..... 347/50

[58] Field of Search ..... 347/47, 50, 54, 347/70, 71, 152

[56] References Cited

U.S. PATENT DOCUMENTS

| | | | |
|---|---|---|---|
| 5,359,357 | 10/1994 | Takagi et al. | 347/49 |
| 5,481,289 | 1/1996 | Arashima et al. | 347/93 |
| 5,579,039 | 11/1996 | Kurata et al. | 347/49 |

FOREIGN PATENT DOCUMENTS

| | | |
|---|---|---|
| 3-104643 | 5/1991 | Japan . |

*Primary Examiner*—Edward Tso

*Attorney, Agent, or Firm*—Sughrue, Mion, Zinn, Macpeak & Seas, PLLC

[57] ABSTRACT

In an ink jet printer, a recording unit in which an ink cartridge is detachably mounted has a cartridge removal preventing member so that the ink cartridge is prevented from being carelessly removed therefrom, and a moving mechanism is provided which, when the recording unit is mounted on the carriage, moves a first electrical connecting section towards a second electrical connecting section so that the first and second electrical connecting section are connected to each other with the aid of an energizing member under pressure, and, when the recording head is removed from the carriage, moves the first electrical connecting section away from the second electrical connecting section against the elastic force of the energizing member, whereby the recording head is detachably mounted on the carriage, and the former is positively electrically connected to the latter.

21 Claims, 25 Drawing Sheets

160
161
162
163
164
164a
164b
164c
165
b

INK JET TYPE RECORDING UNIT WITH AN IMPROVED CARRIAGE STRUCTURE

BACKGROUND OF THE INVENTION

1. Field of the Invention

This invention relates to ink jet type printers, and particularly to an ink jet type recording unit with an ink jet head (hereinafter referred to merely as "a head", when applicable) and the structure of a carriage supporting the ink jet type recording unit, and more particularly to an ink jet type recording unit which has an ink jet type recording head and an ink cartridge as one unit and can be mounted on or demounted from the carriage when required, and to the connection of the ink jet type recording unit with the carriage.

2. Related Art

In general, an ink jet printer comprises: a carriage which is reciprocated while being guided by a guide shaft laid across the direction of conveyance of a printing sheet; and an ink jet head which is mounted on the carriage to jet ink onto the printing sheet.

Some of the conventional ink jet printers are designed so that the ink jet head and the ink cartridge are provided as one unit, which is detachably mounted on the carriage.

In the conventional ink jet printers thus designed, it is not permitted to connect the unit directly to the carriage by soldering, and therefore wiring must be suitably made to drive the head.

In this connection, Japanese Patent Application (OPI) No. 104643/1991 has disclosed the following printer: As shown in FIG. 28, one end portion 2 of a flexible printed cable (hereinafter referred to as "an FPC", when applicable) is set on a carriage 1, and a unit 3 has a base board 3*a* which is connected to the end portion 2 of the FPC under pressure. Hence, the unit 3 can be detachably mounted on the carriage 1. The other end portion of the FPC is connected to the control board in the printer body.

In FIG. 28, reference numeral 4 designates a lever which is operated by the operator. The lever 4 is swingably supported by supporting portions 1*a* and 1*a* of the carriage 1.

Further in FIG. 28, reference numeral 5 designates a hook member. The hook member 5 includes: a hook 5*b* which is engageable with an engaging portion 3*b* of the unit 3; and a base portion 5*a* which is engaged with a plate cam 4*a* of the lever 4.

The unit 3 is mounted on the carriage 1 as follows: The hook member 5 is moved in the direction of the arrow X1 by turning the lever 4. Thereafter, the unit 3 is placed on the carriage 1 in such a manner that a protrusion 3*c* extending from the lower end portion of the unit is abutted against a supporting portion 1*c* of the carrier, and an engaging portion 3*b* of the unit is engaged with the hook 5*b* of the hook member. The unit 3 thus placed is slightly inclined in the direction of the arrow a1. Under this condition, the hook member 5 is moved in the direction of the arrow X2 by turning the lever 4, as a result of which, with the hook 5*b* firmly engaged with the engaging portion 3*b* of the unit, the unit 3 is turned in the direction of the arrow a2, so that the base board 3*a* of the unit is pushed against the end portion 2 of the FPC. Thus, the unit 3 has been fixedly mounted on the carriage 1 as shown in FIG. 28.

In the above-described printer, it is essential to positively connect the base board 3*a* to the end portion 2 of the FPC. For this purpose, in the printer, a rubber pad 6 is provided behind the end portion 2 of the FPC in such a manner that the rear portion of the pad 6 is supported by a plate 1*d* formed on the carriage, while the hook member 5 is urged in the direction of the arrow X2 by a spring 8, whereby the base board 3*a* is pushed against the end portion 2 of the FPC under pressure.

However, the above-described conventional printer suffers from the following problems: In mounting the unit 3 on the carriage; that is, in connecting the end portion 2 of the FPC to the base board 3*a*, the unit 3 inclined in the direction of the arrow a1 is rotated in the direction of the arrow a2. As the unit 3 is rotated in this way, the base board 3*a* is gradually pushed against the end portion 2 of the FPC; in other words, the base board 3*a* and the end portion 2 of the FPC are gradually connected with each other beginning with their lower ends as indicated at b1 (towards their upper ends as indicated at b2).

Hence, the base board 3*a* and the end portion 2 are liable to be non-uniformly connected to each other. If the connection of the base board 3*a* to the end portion 2 is not uniform, then the electrical connection of the head and the carriage may be not reliable.

The connection of the base board 3*a* and the end portion 2 of the FPC may be made uniform by increasing the pressing force of the rubber pad 6 supporting the end portion 2. However, the increasing of the pressing force of the rubber pad 6 is limited, depending on the mechanical strengths of the carriage 1 and other components.

That is, in the above-described printer, it is difficult to uniformly connect the base board 3*a* and the end portion 2 of the FPC to each other.

The ink jet type printer performs a printing operation while forming dots on a recording medium with ink droplets jetted from its ink jet nozzles. Hence, with the printer, a monochromatic printing operation or a color printing operation can be readily achieved by using printing inks different in color.

In this connection, an ink jet type printer has been put in practical use in which a monochromatic printing recording head and a color printing recording head are mounted on the carriage. The printer of this type is advantageous in that one printer can provide not only monochromatic prints such as text prints but also color prints such as color graphic prints. However, the printer is not suitable for a user who uses it mainly for the monochromatic printing operation. That is, the maintenance of the color printing recording head is rather troublesome to him because he does not so frequently use it.

In order to overcome the above-described difficulty, an ink jet type recording apparatus has been proposed in the art in which an ink cartridge and an ink jet type recording head are provided as one recording unit, and a recording unit suitable for printing given recording data is detachably mounted on the carriage.

The ink jet type recording apparatus thus proposed is advantageous in that a desired printing operation can be achieved by replacing the recording unit with one suitable for the printing operation, and that the recording units which are not in use can be sealingly stored in the casings, so that they are free from maintenance.

However, the ink jet type recording apparatus is still disadvantageous in that, when the ink in the cartridge is used up, it is necessary to replace not only the ink jet type recording head but also the ink cartridge, which results in an increase in printing cost.

In order to overcome the above-described difficulties, an ink jet type recording unit has been proposed in the art in which an ink cartridge accommodating chamber is provided in a frame in which an ink jet type recording head is set, so that the ink cartridge can be readily replaced with another one.

However, the employment of this type of ink jet recording unit gives rise to another problem. That is, when the ink cartridge is replaced with another one, after which the ink jet recording unit is removed from the carriage, air is allowed to enter the recording head during loading or unloading of the ink cartridge. If the recording head including the air is used as it is, then the ink discharging operation becomes unsatisfactory, which makes it impossible to perform or continue the printing operation.

SUMMARY OF THE INVENTION

In view of the foregoing, a first object of the invention is to provide an ink jet printer in which a recording unit is detachably mounted on the carriage, and the recording unit is positively electrically connected to the carriage.

A second object of the invention is to provide an ink jet type recording unit in which, when removal of the bubbles therefrom is impossible, replacement of its ink cartridge is prevented.

(1) The first object of the invention has been achieved by the provision of an ink jet printer which, according to one aspect of the invention, comprises:

- an ink jet type recording head for jetting printing ink towards a printing sheet to print given data thereon;
- a carriage on which the ink jet type recording head is detachably mounted;
- a substantially flat-plate-shaped first electrical connecting section provided on the carriage;
- a substantially flat-plate-shaped second electrical connecting section provided on the ink jet type recording unit, so as to be connected to the first electrical connecting section under pressure;
- an energizing member adapted to connect the first electrical connecting section to the second electrical connecting section under pressure; and
- a unit moving mechanism which,
  - when the ink jet type recording unit is mounted on the carriage, moves the first electrical connecting section towards the second electrical connecting section so that the first and second electrical connecting sections are connected to each other under pressure by the energizing member, and
  - when the ink jet type recording unit is removed from the carriage, moves the first electrical connecting section away from the second electrical connecting section against the elastic force of the energizing member.

It is preferable that, in the ink jet printer, the first electrical connecting section comprises one end portion of an FPC the other end portion of which is connected to a control section in a printer body, and the unit moving mechanism has a pad made of an elastic material which is arranged behind the first electrical connecting section so that the first electrical connecting section is connected to the second electrical connecting section under pressure through the pad.

Furthermore, it is preferable that, in the ink jet printer, the unit moving mechanism has a flat-plate portion which supports the pad and is moved back and forth with respect to the second electrical connecting section, the flat-plate portion supporting the pad in such a manner that the pad is slightly movable in a direction perpendicular to the direction in which the flat-plate portion is moved back and forth.

Moreover, it is preferable that the ink jet printer further comprises: a mounting mechanism which, when the ink jet type recording unit is mounted on the carriage, fastens the ink jet type recording unit to the carriage, and when the ink jet type recording unit is removed from the carriage, unfastens the ink jet type recording unit from the carriage, the mounting mechanism operating in association with the unit moving mechanism.

(2) The second object of the invention has been achieved by the provision of an ink jet type recording unit which, according to another aspect of the invention, comprises:

- a casing which can be detachably mounted on a carriage and has an ink cartridge accommodating chamber;
- an ink jet type recording head which, when the casing is mounted on the carriage, is fixed at a position where the ink jet recording head is confronted with a platen;
- a circuit board in which circuit means for driving the recording head is built, and which has contacts which are connected to contacts provided on a recording apparatus body,
  - the circuit board being connected through a flexible cable to the recording head,
- ink supplying needles for supplying inks from an ink cartridge to the ink jet type recording head;
- a cartridge fixing lever which is swingably provided at one end of the casing, to load an ink cartridge in the casing and unload the ink cartridge from the casing; and
- a cartridge locking member which,
  - when the cartridge is loaded in the casing, is normally protruded towards the cartridge to prevent the cartridge from coming off, and
  - when the casing is fixedly mounted on the carriage, is retracted so as to permit the loading and unloading of the ink cartridge.

It is preferable that, in the ink jet type recording unit, the cartridge fixing lever has protrusions on the side of the center of swing thereof which are engaged with the lower surfaces of ribs formed on both sides of the upper end face of the ink cartridge; and when the cartridge fixing lever is swung downwardly, the ink cartridge is pushed into the casing through the lower surface of the lever, and when the cartridge fixing lever is swung upwardly, the ink cartridge is pulled out of the casing with the protrusions engaged with the ribs.

Furthermore, it is preferable that, in the ink jet type recording unit, in the case where the cartridge locking member has been retracted from the ink cartridge accommodating chamber, and the ink cartridge is inserted into the casing with the cartridge fixing lever released, the ink cartridge is supported by the cartridge fixing lever and one side wall of the casing.

Moreover, it is preferable that, in the ink jet type recording unit, the ink cartridge locking member is so positioned that, when the ink cartridge abuts against the upper surface thereof, the ink cartridge locking member holds the ink cartridge so that the ink supplying outlets of the ink cartridge are spaced from the ink supplying needles.

In addition, it is preferable that, in the ink jet type recording unit, independent of the kind of ink jet type recording head used, the carriage is so shaped as to be able to accommodate a printing unit of maximum size, and is adjusted in size so that at least the lower half of the casing conforms to the configuration of an opening of the carriage.

Further, in the ink jet type recording unit, preferably the ink cartridge is divided into a plurality of chambers with partition walls in which a plurality of kinds of printing inks are stored, and has a recess in an outer surface thereof which is opposed to the partition wall, and the ink cartridge locking member is engaged with the recess when protruded towards the ink cartridge accommodating chamber.

Preferably, in the ink jet type recording unit, the ink jet type recording head is fixed to the lower surface of the casing through a head casing, the outer periphery of which is formed into a frame.

In addition, preferably, in the ink jet type recording unit, the casing has a window in a portion thereof which is confronted with the head casing, the ink supplying needles are embedded in the head casing, and annular protrusions, which have a larger inside diameter than the ink supplying outlets, are formed around the ink supplying needles.

Furthermore, in the ink jet type recording unit, a plurality of ribs are formed on the surfaces of the walls of the head casing to position the ink cartridge.

Additionally, in the ink jet type recording unit, preferably the upper end faces of the ribs are located below the upper surface of the head casing, and both side surfaces of each of the ribs merge smoothly with the side surface of the head casing.

Moreover, in the ink jet type recording unit, preferably one end portion of the flexible cable, on the side of the ink jet type recording head, has a tongue-shaped piece which is grounded, and the tongue-shaped piece is elastically pressed so as to be electrically connected to a conductive part of the ink jet type recording head.

In the ink jet type recording unit, preferably a protrusion is formed on a part of the tongue-shaped piece which is brought into contact with the recording head.

Furthermore, in the ink jet type recording unit, preferably a stepped portion adapted to push the protrusion against the recording head is formed in opposition to the tongue-shaped portion.

Moreover, in the ink jet type recording unit, preferably the casing has a window through which the ink cartridge can be visually detected.

Preferably, in the ink jet type recording unit, the circuit board has a plurality of patterns which can be cut or short-circuited to set a voltage for driving the ink jet type recording head, and whether or not an ink jet type recording unit is loaded in the recording apparatus body is determined from the form of the patterns.

Additionally, in the ink jet type recording unit, preferably the circuit board has a circuit pattern which is cut or short-circuited to indicate whether a color printing recording unit is loaded or whether a monochromatic printing recording unit is loaded.

BRIEF DESCRIPTION OF THE DRAWINGS

In the accompanying drawings:

FIG. 3(*b*) is a plan view of the nozzle surface of the printing head;

FIG. 5(*c*) is a sectional view taken along line c—c in FIG. 5(*b*);

FIGS. 6(*d*) and 6(*e*) are sectional views taken along line d—d and line e—e in FIG. 6(*b*), respectively;

FIG. 7(*c*) is a sectional view taken along line c—c in FIG. 7(*b*);

FIG. 7(*e*) is an enlarged diagram showing part of FIG. 7(*c*);

DETAILED DESCRIPTION OF THE PREFERRED EMBODIMENTS

Preferred embodiments of the invention will be described with reference to the accompanying drawings.

Figure 1:
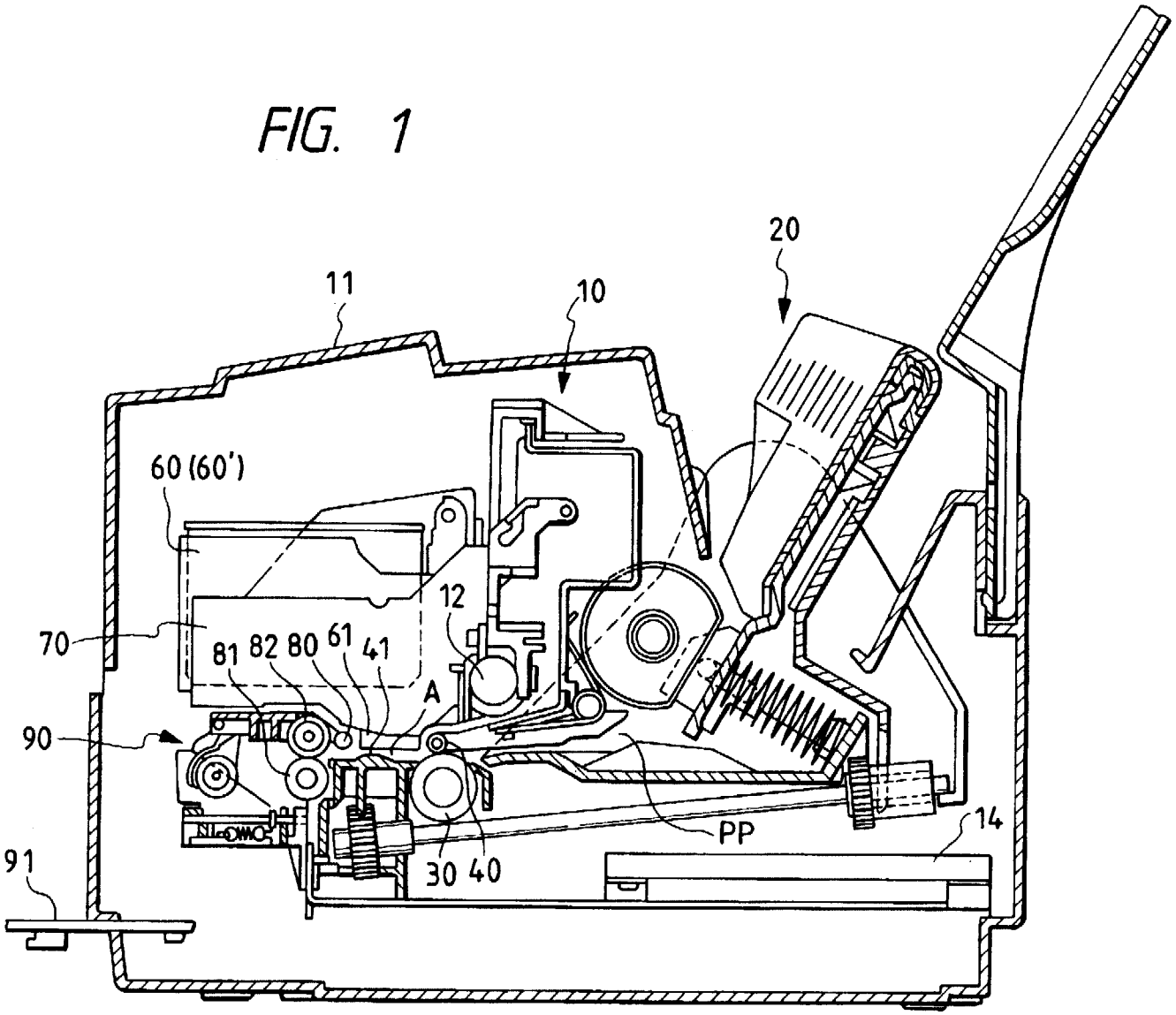
FIG. 1 is a sectional side view showing an internal structure of an example of an ink jet printer according to the invention.
Figure 11:
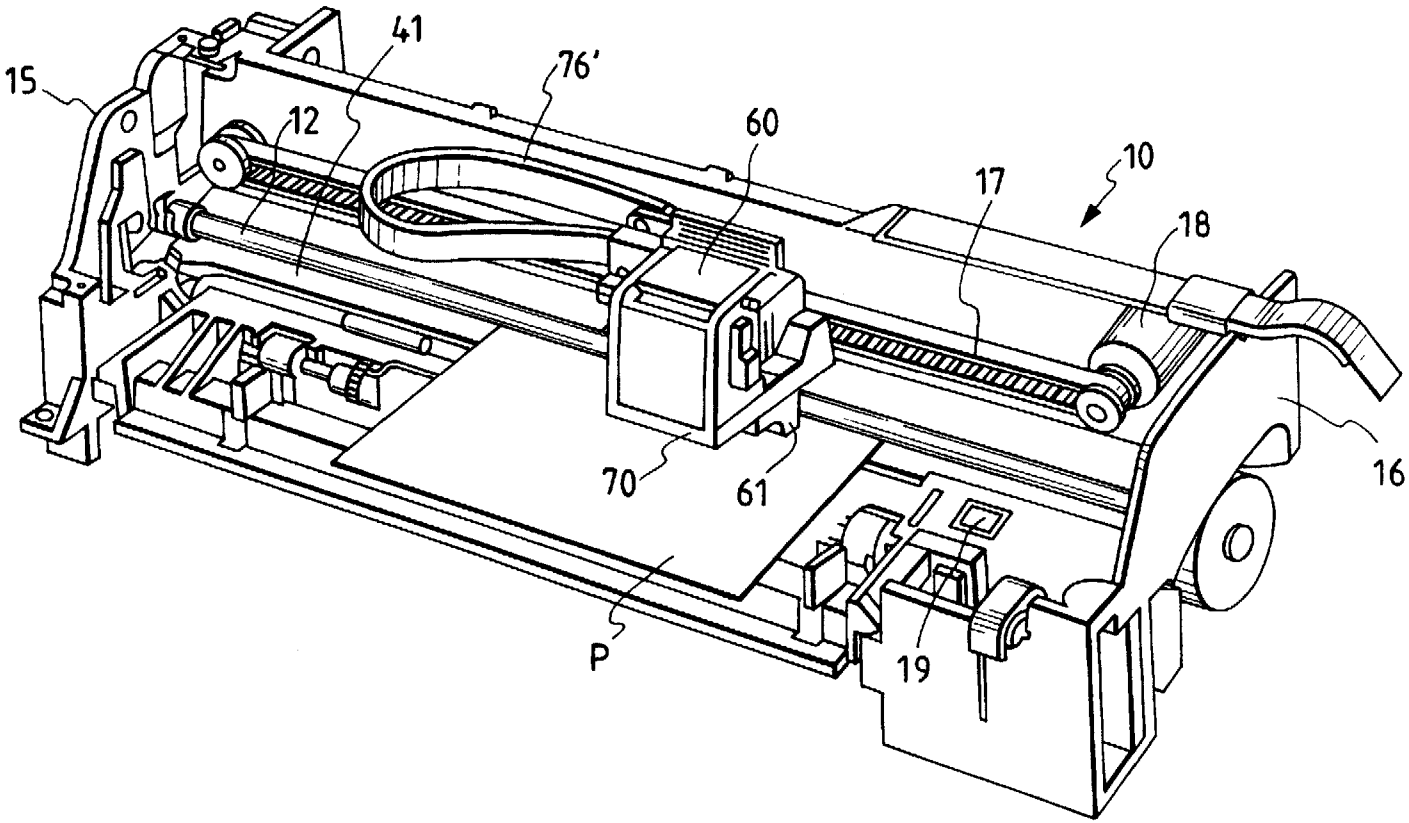
FIG. 11 is a diagram showing essential parts of the internal structure of a printer to which an ink jet type recording unit according to the invention is applied.

FIG. 1 is a sectional side view showing the internal structure of an example of an ink jet printer according to the invention, and FIG. 11 is a perspective view showing essential parts of the internal structure of the printer.

First, the arrangement of the ink jet printer will be outlined.

Mainly in FIG. 1, reference numeral 10 designates a printer body; 11, a printer body casing; and 20, an automatic sheet supplying device built in the printer body 10.

In the printer body 10, what are provided along a sheet conveying path PP on which a printing sheet P (not shown) supplied from the automatic sheet supplying device 20 is conveyed, are a sheet conveying roller 30, a pinch roller 40 pressed against the roller 30 so as to be driven by the latter 30, a regulating member (or a platen) 41 for guiding the rear surface of the printing sheet, a carriage 70 on which an ink jet type recording unit 60 (hereinafter referred to as "a recording unit 60" or merely as "a unit 60", when applicable) is mounted which has an ink jet type head section 61 adapted to jet printing ink onto a printing sheet, a guide roller 80, a pair of sheet discharging rollers 81 and 82, and a sheet discharging section 90. A sheet discharging tray 91 is provided in front of the printer body 10 so that sheets discharged from the printer body are stacked on it.

A printing sheet P supplied from the automatic sheet supplying device 20 is conveyed along the sheet conveying path PP, which is curved downwardly as a whole, to the sheet conveying roller 30, where it is regulated in the angle of conveyance by the pinch roller 40. The sheet P thus regulated is further conveyed on. Thereafter, the front end portion of the sheet P is guided by the regulating member 41 which serves also as a guide member, so that a predetermined distance is provided between the sheet and the ink jet head section 61. Under this condition, the latter 61 jets printing ink onto the printing sheet P to print given data on the latter P. In FIG. 1, reference character A designates a printing region. The sheet thus printed is moved onto the sheet discharging tray 91 by means of the pair of sheet discharging rollers 81 and 82 and the sheet discharging section 90.

The ink jet type recording unit 60, and the carriage will be described with reference to FIGS. 2 through 4 in more detail.

Figure 2:
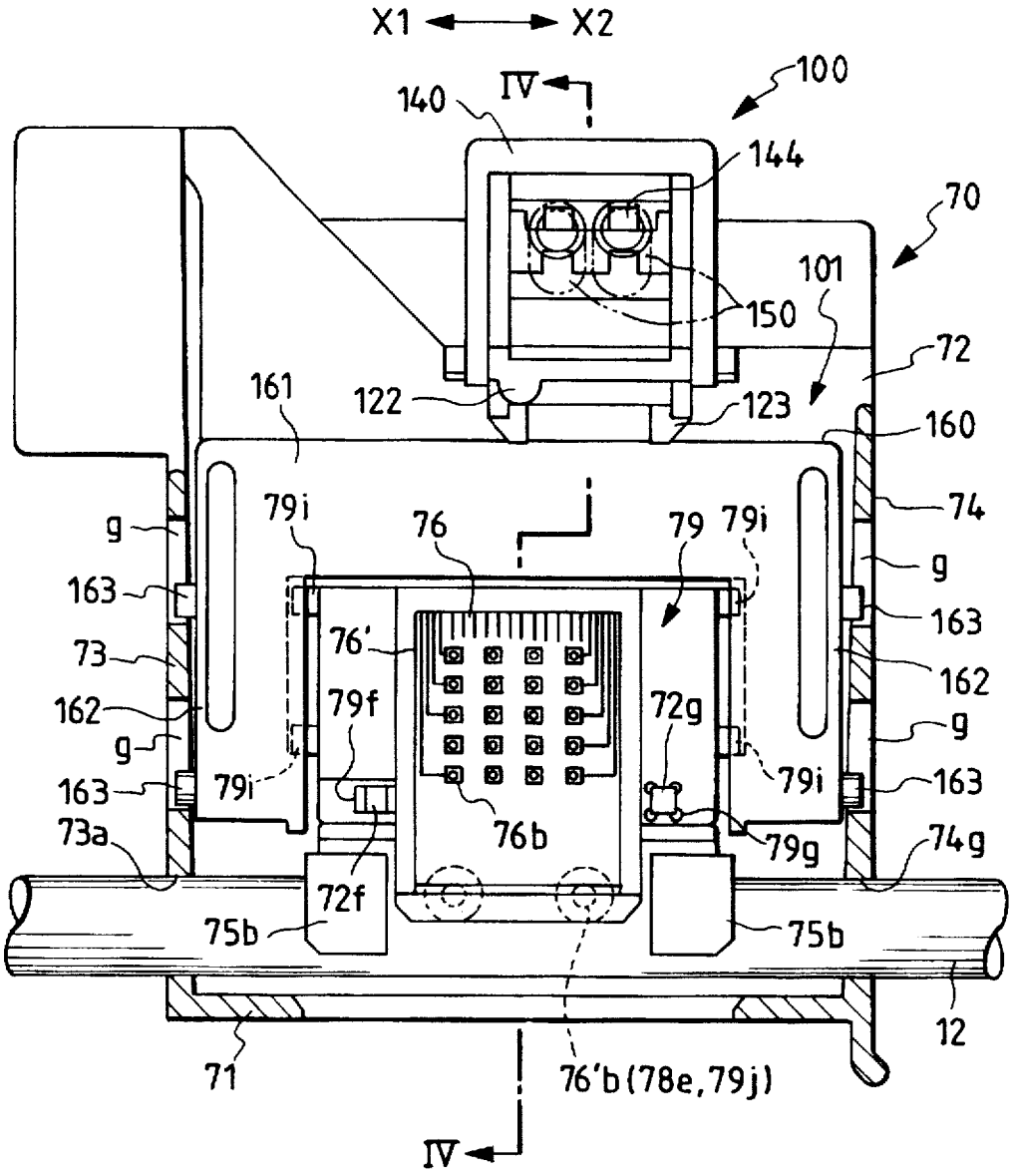
FIG. 2 is a front view, with parts cut away, of a carriage in the printer.

FIG. 2 is a front view, with parts omitted, showing the carriage. FIG. 3(*a*) is a plan view, with parts omitted, showing the carriage 70 on which the recording unit 60 is mounted. FIG. 4 is a sectional view, with parts omitted, showing the carriage on which the recording unit is mounted (corresponding to a sectional view taken along line IV—IV in FIG. 2).

As shown in those figures, the carriage 70 has a bottom board 71, a rear board 72, right and left side boards 74 and 73, a mounting mechanism 100, and a moving mechanism 101.

Those side boards 73 and 74 have bearing holes 73*a* and 74*a*, into which a guide shaft 12 is inserted (cf. FIG. 1). As shown in FIG. 4, the front end portion (the left end portion in FIG. 4) of the bottom board 71 is supported by a guide board 13. The guide board 13, and the guide shaft 12 are supported on side frames 15 and 16 (cf. FIG. 11) of the printer body 10. The rear board 72 has an engaging portion 72*a* which is provided for a timing belt 17 (cf. FIG. 11). As the timing belt 17 is driven by a carriage motor (or step motor) 18 (cf. FIG. 11), the carriage 70 is reciprocated, or moved in the directions of the arrows X1 and X2 (perpendicular to the drawing of FIG. 1) while being guided by the guide shaft 12 and the guide board 13.

Figure 4:
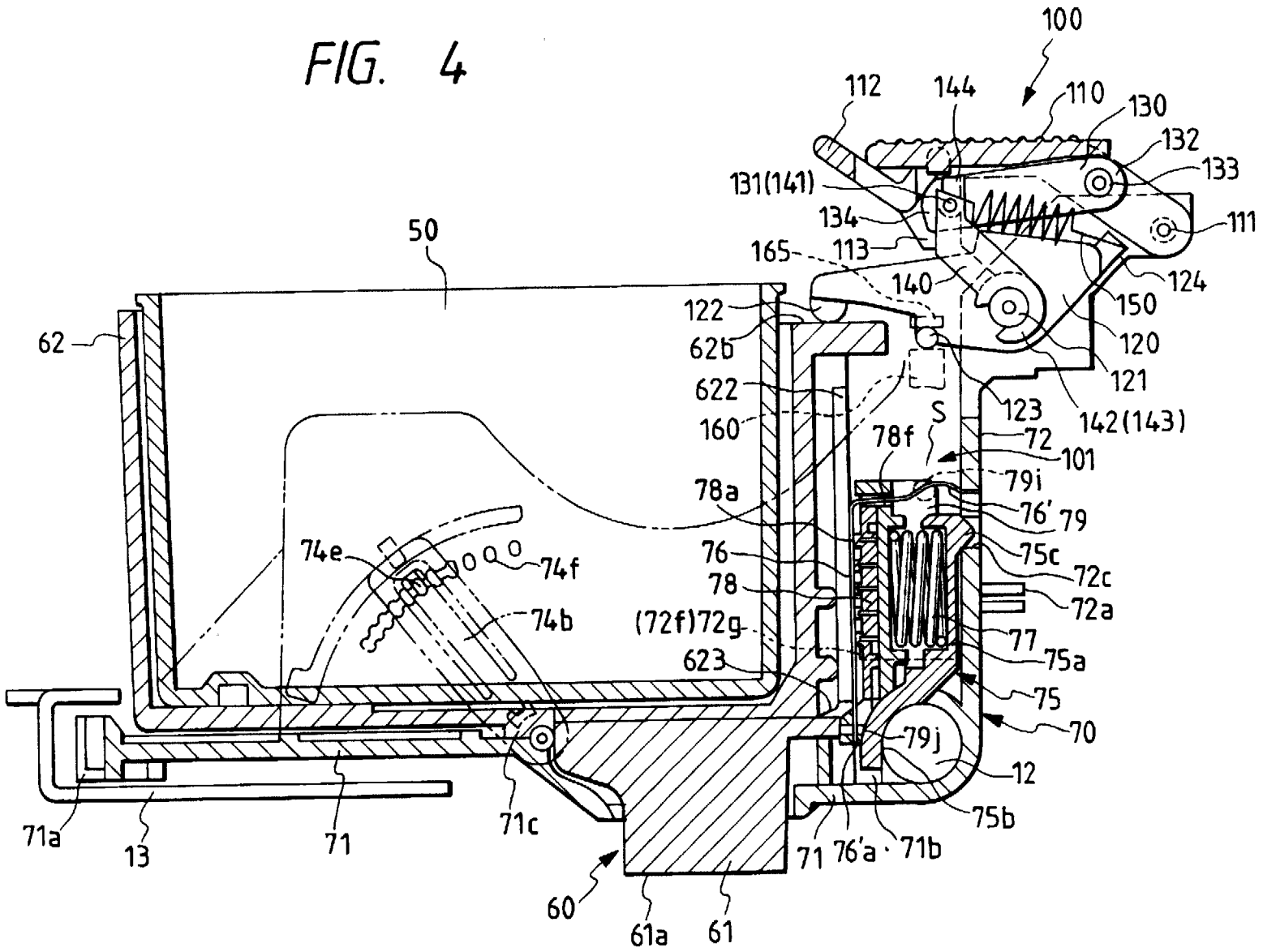
FIG. 4 is a sectional view taken along line IV—IV in FIG. 2.

As shown mainly in FIG. 4, the carriage 70 has a space S which is adjacent to both the guide shaft 12 and the ink jet type recording unit 60. The space S accommodates a play preventing member 75 for preventing the play of the carriage 70 with respect to the guide shaft 12, a first electrical connecting section 76, an energizing member 77 made of a compression spring, and the moving mechanism 101.

Figure 5A:
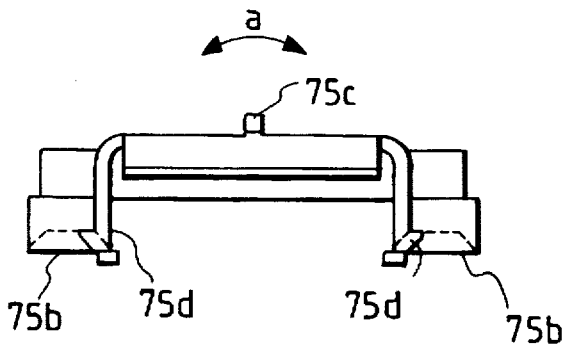
FIGS. 5(*a*) and 5(*b*) are a plan view and a front view showing a play preventing member.
Figure 5B:
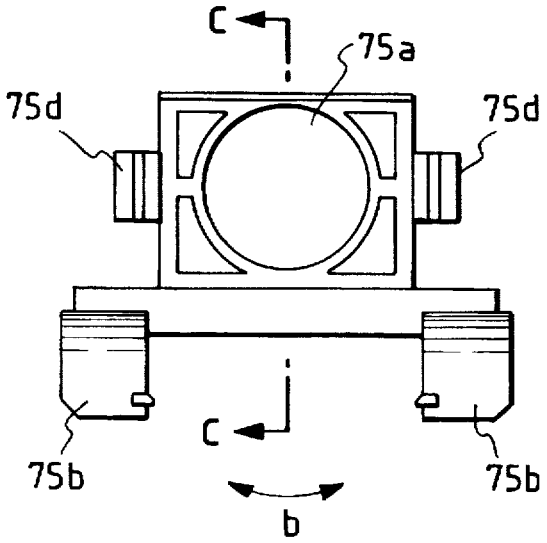
Figure 5C:
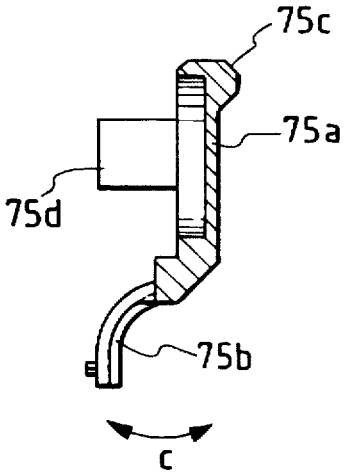
Figure 6A:
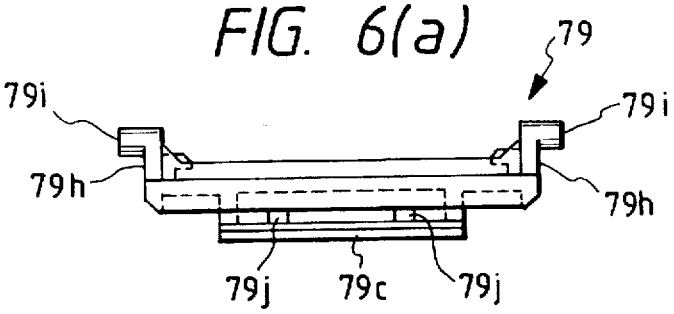
FIGS. 6(*a*), 6(*b*) and 6(*c*) are a plan view, a front view, and a left side view of a pad holder in the printer, respectively.
Figure 6C:
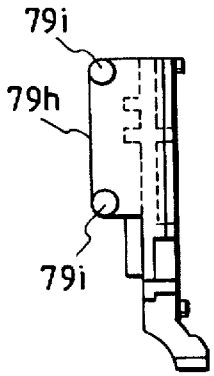
Figure 6B:
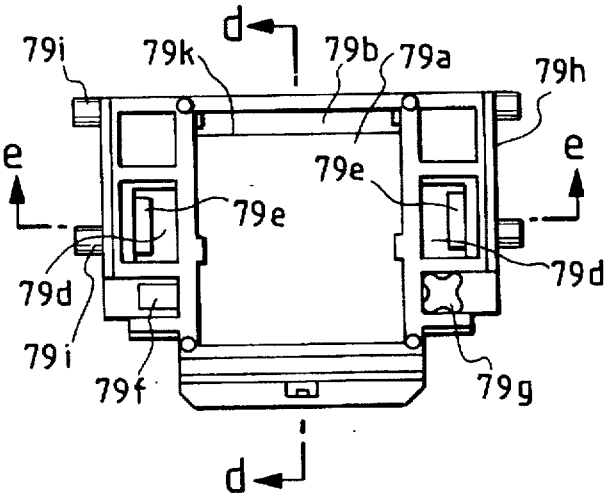
Figure 6D:
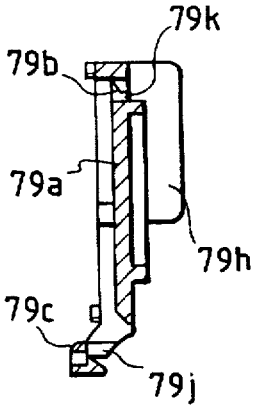
Figure 6E:
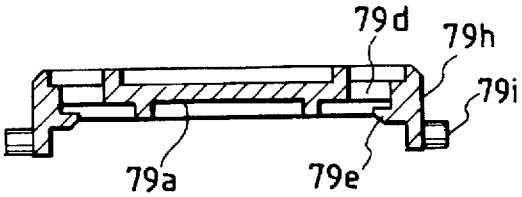
Figure 7A:
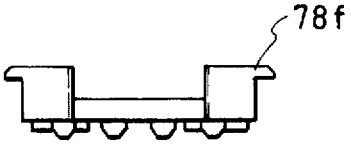
FIGS. 7(*a*), 7(*b*) and 7(*d*) are a plan view, a front view, and a rear view of a pad, respectively.
Figure 7B:
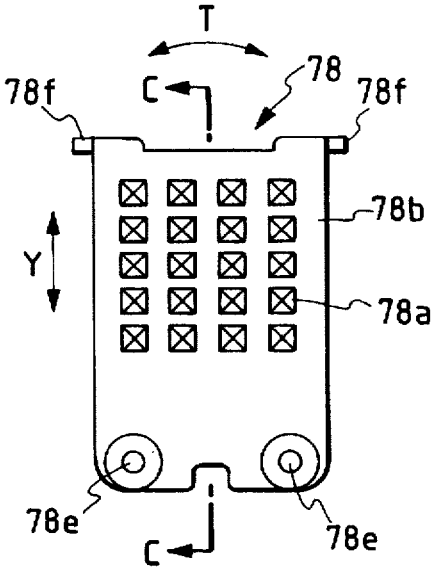
Figure 7D:
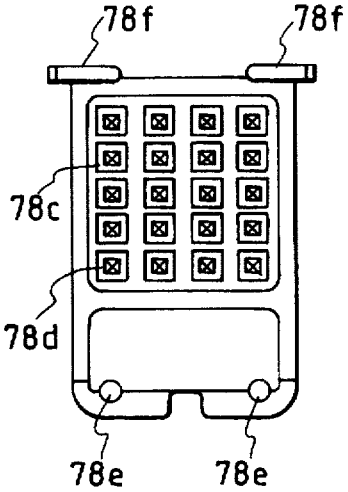
Figure 7C:
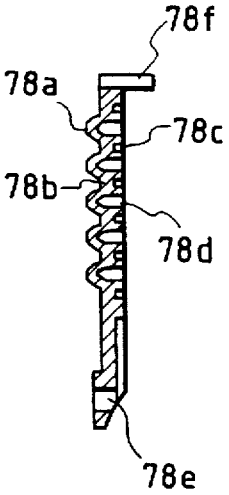
Figure 7E:
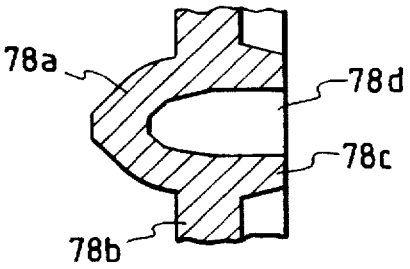

The play preventing member 75, as shown best in FIG. 5, includes: a receiving portion 75*a* which receives the energizing member 77; and sliding sections 75*b* and 75*b* which are set in slide contact with the guide shaft 12.

The receiving portion 75*a* is substantially flat, and the sliding portions 75*b* and 75*b* are extended downwardly from both end portions of the lower edge of the receiving portion 75*a* and curved inwardly so that the inner surfaces of the sliding portions 75*b* thus curved are brought into contact with the guide shaft 12. The receiving portion 75*a* has a protrusion 75*c* on its back. More specifically, the protrusion 75*c* is extended from the middle of the upper edge of the back, and as shown in FIG. 4, it is loosely engaged with a hole 72*c* formed in the rear board 72. Hence, the play preventing member 75 is swingable in the directions of the arrows a, b and c in FIG. 5. In FIG. 5, reference character 75*d* designates temporary hooks which are engaged with a pad holder 79 (described later).

The first electrical connecting section 76 is made up of the end portion of an FPC 76' (as described later), and has a plurality of contacts 76*b* on its surface as shown in FIG. 2.

The moving mechanism 101 comprises: a pad 78 of elastic material (such as rubber); a pad holder 79, and a plate cam 160 which is an operating member for moving the pad holder 79.

The pad 78, as shown in FIG. 7, includes a plate-shaped base 78*b*, protrusions 78*a* extended from one surface of the base 78*b*, and legs 78*c* extended from the other surface of the base 78*b*. The pad 78 including the legs 78*c*, the base 78*b*, and the protrusions 78*a* also has holes 78*d* which are formed in the protrusions 78*a*, respectively.

The protrusions 78*a* of the pad 78 are to push the contacts 76*b* of the first electrical connecting section 76 from behind, and are each substantially in the form of a quadrangular pyramid. The legs 78*c* are each substantially in the form of a quadrangular prism.

In order to fasten the pad 78 to the pad holder 79, the base 78*b* has two through-holes 78*e* and 78*e* in its two corners, and two locking pieces 78*f* and 78*f* at the remaining two corners.

The pad holder 79, as shown best in FIG. 6, is substantially in the form of a flat board, and has a flat plate portion 79*a* at the center which is used to support the pad 78 from behind.

The pad holder 79 has an inserting slit 79*b* above the flat plate portion 79*a* into which the FPC 76' is inserted. In addition, the pad holder 79 has a locking portion 79*c* below the flat plate portion 79*a* to which the pad 78 and the front end portion 76'*a* (cf. FIG. 4) of the FPC 76' are locked. A pair of pins 79*j* and 79*j* are extended backwardly from the locking portion 79*c*.

The pins 79*j* and 79*j* are inserted into the through-holes 78*e* and 78*e* of the pad 78, and the locking pieces 78*f* and 78*f* are engaged with the upper edge 79*k* of the flat plate portion 79*a* of the pad holder 79, so that the pad 78 is coupled to the pad holder 79. The pad 78 is not directly secured to the flat plate portion 79*a*; that is, the former is locked to the latter merely by inserting the pins 79*j* into the through-holes 78*e* and by laying the locking pieces 78*f* on the upper edge 79*k* of the flat plate portion 79*a*. Hence, the pad 78 is slightly movable in the directions of the arrows Y and T as shown in FIG. 7(*b*).

The end portion 76'*a* of the FPC 76' also has through-holes 76'*b* (cf. FIG. 2) similar to those of the pad. By inserting the pins 79*j* into the through-holes 76'*b*, the end portion 76'*a* of the FPC 76' is secured to the pad holder 79. That is, the end portion 76'*a* of the FPC 76' is passed through the inserting slit 79*b* of the pad holder 79 and is moved over the front surface of the rubber pad 78, and is then secured to the locking portion 79*c* of the pad holder 79, thus providing the aforementioned first electrical connecting section 76 in front of the rubber pad 78. As was described before, a plurality of contacts 76*b* are formed on the surface of the first electrical connecting section 76, and the pad 78 has the protrusions 78*a* in correspondence to those contacts 76*b*. The other end portion of the FPC 76' is connected to the control section of the printer body 10.

As shown in FIG. 6, the pad holder 79 has a pair of rectangular holes 79*d* on both sides of the flat plate portion 79*a*, and a pair of protrusions 79*e* which are extended in the rectangular holes 79*d*, respectively. The above-described hooks 75*d* of the play preventing member 75 are inserted into those rectangular holes 79*d* until they are engaged with the protrusions 79*e*, respectively, so that the pad holder 79 and the play preventing member 75 are temporarily locked to each other.

The pad holder 79 has a positioning rectangular hole 79*f* below the left rectangular hole 79*d*, and a positioning X-shaped hole 79*g* below the right rectangular hole 79*d*. The positioning rectangular hole 79*f* is slightly elongated horizontally. As shown in FIGS. 2 and 4, quadrangular-prism-like pieces 72*f* and 72*g* extended forwardly from the rear board 72 are inserted into the aforementioned positioning holes 79*f* and 79*g*, respectively. That is, the pad holder 79 is positioned vertically with the quadrangular-prism-like piece 72*f* engaged with the rectangular hole 79*f*, and it is positioned vertically and horizontally with the quadrangular-prism-like piece 72*g* engaged with the X-shaped hole 79*g*, and it is movable back and forth (right and left in FIG. 4) being guided by those quadrangular prisms 72*f* and 72*g*.

The pad holder 79 further includes right and left side boards 79*h* and 79*h*. Each of the side boards 79*h* has upper and lower pins 79*i* in such a manner that those pins 79 are abutted against the cam surface of the plate cam 160 (described below).

Figures 8A, 8B, 8C, 8D:
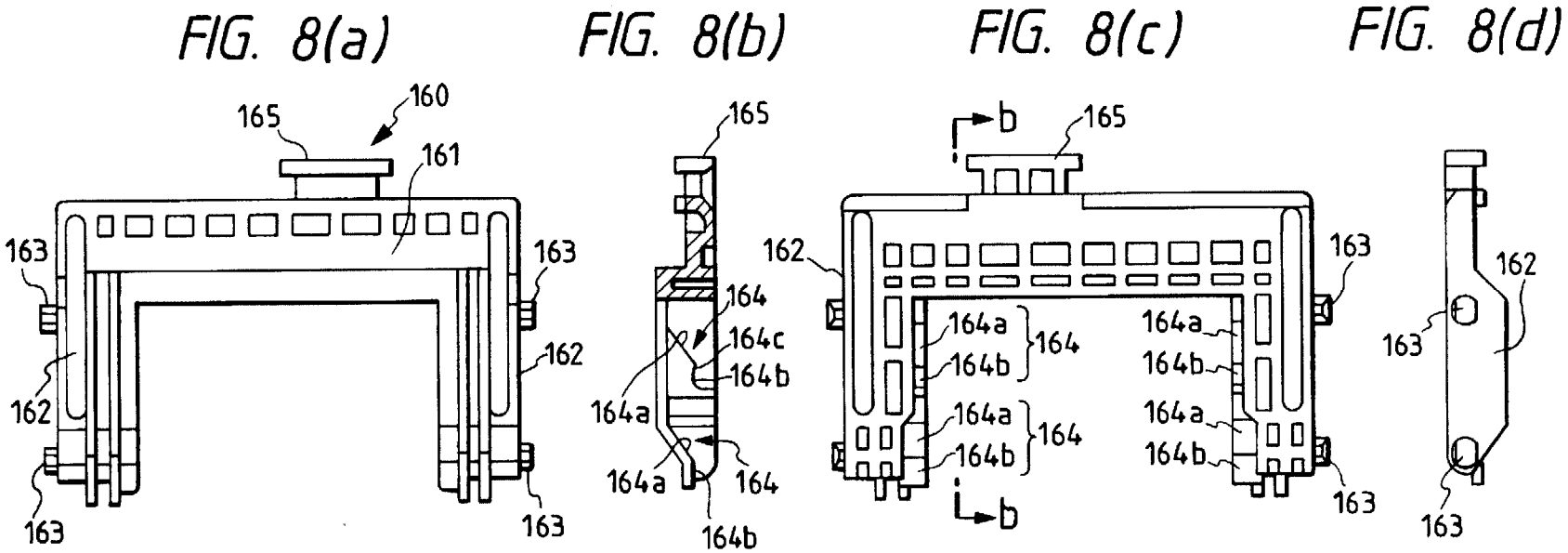
FIGS. 8(*a*)–8(*d*) show a plate cam. More specifically, FIGS. 8(*a*) and 8(*c*) are a front view and a rear view of the plate cam, respectively, FIG. 8(*b*) is a sectional view taken along line b—b in FIG. 8(*c*), FIG. 8(*d*) is a right side view with FIG. 8(*c*) as a front view.

The plate cam 160 is as shown in FIG. 8. FIG. 8(*a*) is a front view of the plate cam; FIG. 8(*b*) is a sectional side view of the plate cam (or a sectional view taken along line b—b in FIG. 8(*c*)); FIG. 8(*c*) is a rear view of the plate cam; and FIG. 8(*d*) is a right side view of the plate.

The plate cam 160 includes a horizontal member 161, and a pair of vertical members 162 and 162 which are extended downwardly from both ends of the horizontal member; that is, it is substantially U-shaped, embracing the pad holder 79 (cf. FIG. 2).

Figure 9:
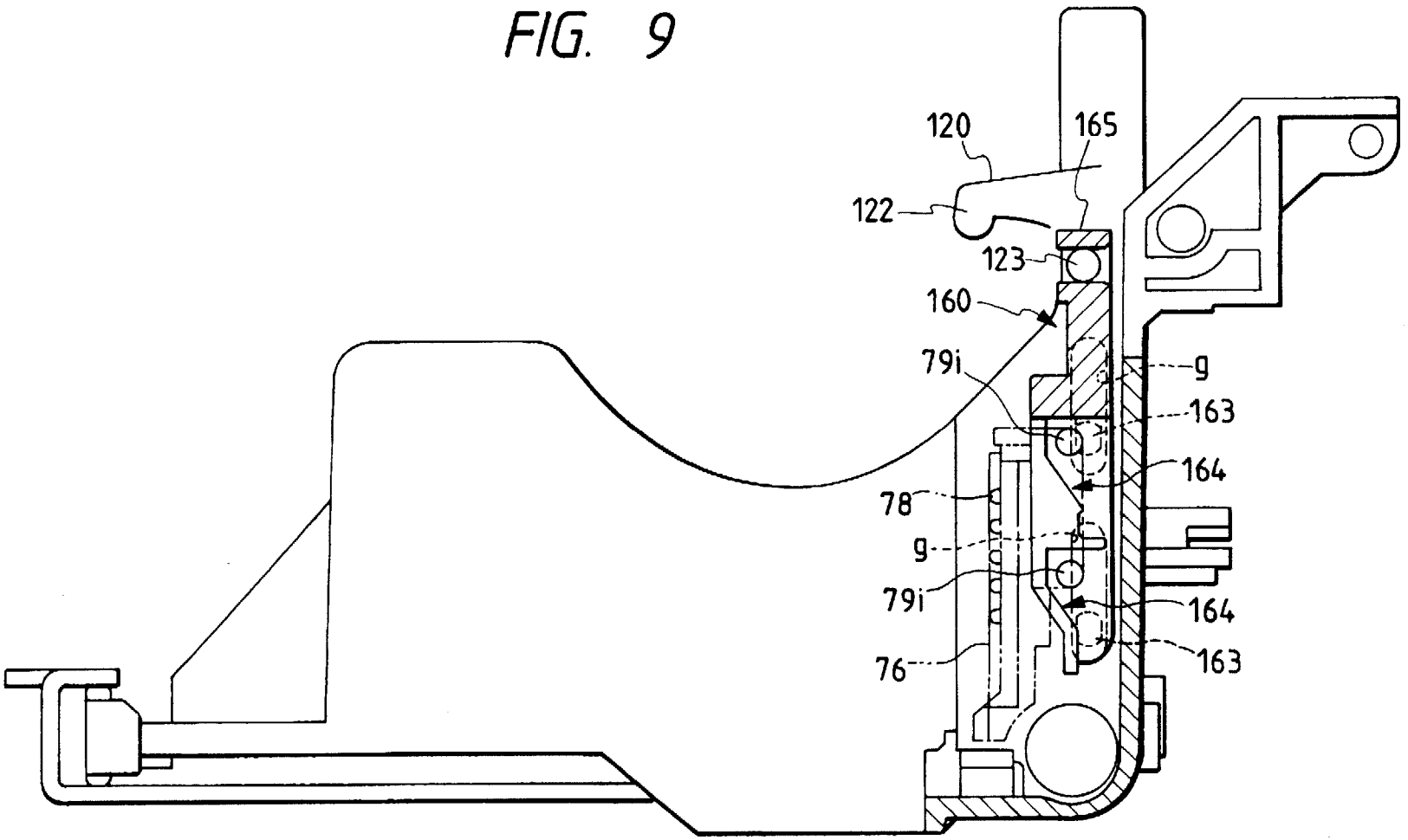
FIGS. 9 and 10 are explanatory diagrams for a description of the operation of a unit moving mechanism.

Each of the vertical members 162 has upper and lower pins 163 on its outer edge. Those pins 163 of the vertical members 162, as shown in FIGS. 2 and 9, are engaged with elongated holes g formed in the side boards 73 and 74. With the pins 163 being guided by the elongated holes g, the plate cam 160 is vertically movable. The sliding portions of the pins 163 which are brought into slide contact with the elongated holes g are flattened to increase their wear-resistance.

Each of the vertical members 162 and 162 has upper and lower cam surfaces 164 and 164 in its rear surface, in such a manner that the pins 79*i* of the pad holder 79 are abutted against those cam surfaces 164, respectively. Each of the cam surfaces 164 is made up of an inclined surface 164*a* and a vertical surface 164*b* (which is parallel with the direction of movement of the plate cam). In each of the upper cam surfaces 164, a clicking protrusion is formed along the border line between the inclined surface 164*a* and the vertical surface 164*b* so that the respective pin is clicked when operated. The four inclined surfaces 164*a* are all equal in the angle of inclination to one another; that is, they are all in parallel with one another.

A locking piece 165 is extended from the upper edge of the horizontal member 161. The locking piece 165 is coupled to a hook-shaped coupling portion 123 of the mounting mechanism 100 (described later), so that the vertical motion of the plate cam 160 is effected in association with the operation of the mounting mechanism 100.

As shown in FIG. 4, the ink jet type recording unit 60 includes the aforementioned head section 61, and a casing 62.

The recording unit 60 shown in FIG. 4 is a full-color printing unit. As shown in FIG. 3(*b*) a red ink jetting nozzle array NR, a yellow ink jetting nozzle array NY, and a blue ink jetting nozzle array NB are provided on the lower surface of the head section 61, namely, a nozzle surface 61*a* which confronts with the printing sheet. Each of the arrays is made up of twenty-four (24) nozzles n which are arranged in two lines (twelve nozzles per line). That is, the nozzle surface 61*a* has seventy-two nozzles n.

The casing 62 accommodates an ink cartridge 50 (as described later). A lever and other components (described later) are provided for the casing 62, to fix the ink cartridge 50. The ink cartridge 50 is divided into three ink chambers which are filled with a red ink, a yellow ink, and a blue ink, respectively.

Figure 3A:
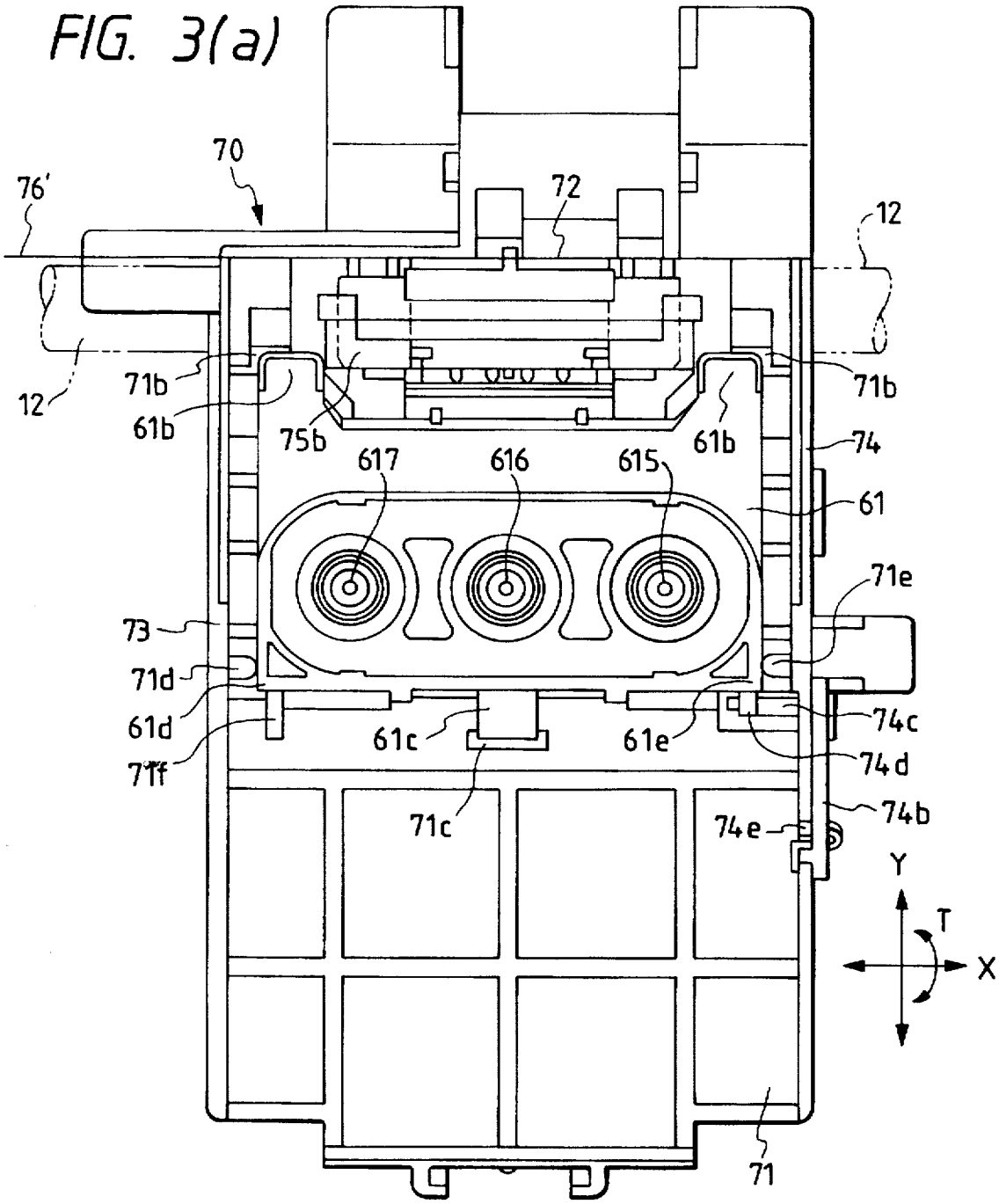
FIG. 3(*a*) is a plan view, with parts omitted, showing the carriage on which a printing head is mounted.
Figure 3B:
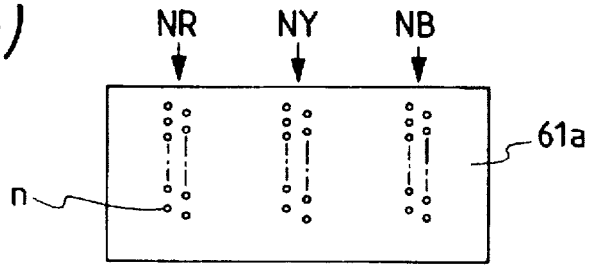

Three needles 615, 616 and 617 (see FIG. 3(*a*)) with flow paths are provided on the upper surface of the head section 61. When the ink cartridge 50 is set in the casing 62, the needles 615, 616 and 617 are inserted into the respective ink chambers of the ink cartridge 50, so that the red, yellow and blue inks are supplied through the flow paths to the nozzle arrays NR, NY and NB, respectively.

Nozzle driving elements are built in the head section 61. Those nozzle driving elements are selectively activated to cause the respective nozzles to jet ink droplets onto the printing sheet thereby to form the given image on the latter.

A second electrical connecting section 622 is provided on the rear surface of the casing 62. The second electrical connecting section 622 is made up of a substrate. A plurality of contacts are formed on the surface of the substrate so that they are connected to the contacts 76*b* of the first electrical connecting section 76 under pressure. The substrate is connected through an FPC 623 to the above-described nozzle driving elements. The arrangement of the second electrical connecting section 622 will be described later in more detail.

In the ink jet printer, the nozzles must be positioned with high accuracy. Hence, the positioning of the nozzles is carried out with the head section 61. For this purpose, the head section 61 is not integral with the casing 62, and it is formed with much higher tolerances than the latter 62.

To facilitate a full understanding of the positioning of the head, the casing 62 is not shown in FIG. 3(*c*).

As shown FIG. 3(*a*), the head section 61 has a pair of protrusions 61*b* and 61*b* on its rear surface which are extended horizontally from both end portions of the latter in such a manner that the lower surfaces of those protrusions 61*b* are abutted against the upper surfaces of ribs 71*b* formed on the bottom plate 71 of the carriage 70 (cf. FIG. 4). In addition, the head section 61 has a protrusion 61*c* which is formed on the front surface at the middle in such a manner that it is extended horizontally therefrom. The lower surface of the protrusion 61*c* is abutted against the upper surface of a rib 71*c* formed on the bottom board 71 of the carriage 70. Thus, the head section 61 is positioned vertically (in a direction perpendicular to the drawing of FIG. 3).

The bottom board 71 of the carriage 70 has a pair of ribs 71*e* and 71*d* respectively on the upper surfaces of its right and left side portions in such a manner that the rib 71*e* is located substantially at the middle of the right side portion while the rib 71*d* is located substantially at the middle of the left side portion. The inner side surfaces of those ribs 71*e* and 71*d* are abutted against the right and left corner 61*e* and 61*d* of the head section 61, so that the head is positioned horizontally (in the direction of the arrow X in FIG. 3).

The bottom board 71 of the carriage 70 has a rib 71*f* on the upper surface of the left side portion substantially at the middle. The rear surface of the rib 71*f* is abutted against the front surface of the left corner 61*d* of the head section. In addition, an adjusting lever 74*b* is swingably mounted on a shift 74*c* which is provided on the right side board 74 of the carriage 70. The adjusting lever 74*b* has an eccentric cam 74*d* in such a manner that the latter 74*d* abuts against the front surface of the right corner 61*e* of the head section. When the unit 60 is mounted on the carriage 70, as is described later, the unit 60 is urged forwardly by the compression spring 77 (downwardly in FIG. 3, so that it is positioned in the front-to-rear direction (or in the direction of the arrow Y in FIG. 3)). On the other hand, the head section 61 is turned in the direction of the arrow T by operating the adjusting lever 74*b*; that is, the parallelism of the head section with respect to the guide shaft 12 can be adjusted. In general, the adjusting lever 74*b* is turned at the factory or the like, and not by the user. The right side board 74 has a plurality of holes 74*f* which are each engaged with the pin 74*e* one at a time. After the parallelism of the head section with respect to the guide shaft has been adjusted with the adjusting lever, the pin 74*e* is engaged with one of the holes 74*f* (see FIG. 4), so that the lever 74*b* is prevented from being turned carelessly.

The above-described printer has a monochromatic printing unit 60' in addition to the full-color printing unit 60 (cf. FIG. 1). The monochromatic printing unit 60' is completely equal in external configuration to the full-color printing unit 60; however, the former is different from the latter in the number of ink jet nozzles, the number of components concerning the ink jet nozzles; i.e., the number of nozzle driving elements, and the number of ink introducing needles. The unit 60 has, for instance, forty-eight (48) nozzles in four lines—twelve nozzles per line, and one needle which is communicated with those nozzles.

As is shown best in FIG. 4, the first electrical connecting section 76, the second electrical connecting section 622, and the play preventing member 75 are arranged in parallel with the guide shaft 12 in the aforementioned space S.

As shown in FIG. 4, the unit mounting mechanism 100 comprises: an operating lever 110; a unit pressing lever 120; first and second links 130 and 140 through which the operating lever 110 and the unit pressing lever 120 are coupled to each other; and two springs 150 (cf. FIG. 2).

The operating lever 110 is swingably mounted on the carriage 70 through a shift 111. A knob 112 is provided at the end of the operating lever 110, and a hook 113 is provided below the knob 112.

The unit pressing lever 120 is swingably mounted on the carriage 70 through a shaft 121. The unit pressing lever 120 has a protrusion 122 at the end which is adapted to push the unit 60. The above-described plate cam 160 is coupled between the protrusion 122 and the shaft 121 through coupling portions 123. The unit pressing lever 120 has an engaging portion 124 at the rear end which is engaged with the spring 150.

First end portions of the first and second links 130 and 140 are swingably coupled to each other through a coupling part 131 (141). The other end portion of the first link 130 is swingably coupled to the operating lever 110 through a pin 133. The other end portion of the second link 140 is swingably coupled to the shaft 121 of the unit pressing lever 120 through a hook (142) 143. The second link 140 has an engaging portion 144 at the end which is engaged with the spring 150.

The spring 150 is connected between the engaging portion 124 of the unit pressing lever 120 and the engaging portion 144 of the second link 140.

FIG. 4 shows how the unit 60 is mounted on the carriage 70.

As shown in FIG. 4, the protrusion 122 of the unit pressing lever 120 abuts against the upper surface 62*b* of the casing of the unit 60, and the unit 60 is secured to the carriage 70 with the head pushed downwardly by the elastic force of the spring 150. Under this condition, the operating lever 110 is locked with its hook 113 engaged with the front end portion 134 of the first link 130.

In this state, as shown in FIG. 9, the plate cam 160 is located at its lower position, so that the cam surfaces 164 are disengaged from the pins 79*i* of the pad holder 79. Hence, the pad holder 79 pushes the first electrical connecting section 76 against the second electrical connecting section 622 through the pad 78 with the aid of the compression spring 77.

On the other hand, the play preventing member 75 is urged counterclockwise about the protrusion 75*c* by the compression spring 77, so that the sliding portions 75*b* and 75*b* are abutted against the guide shaft 12.

The unit 60 is removed from the carriage as follows: The knob 112 of the operating lever 110 is turned clockwise in FIG. 4. As a result, the knob 112 is elastically deformed, thus being turned with respect to the operating lever. Hence, the hook 113 is disengaged from the end portion 134 of the first link 130, and the operating lever 110 is turned. In association with the rotation of the operating lever 110, the unit pressing lever 120 is turned. Hence, the unit 60 can be removed from the carriage.

Figure 10:
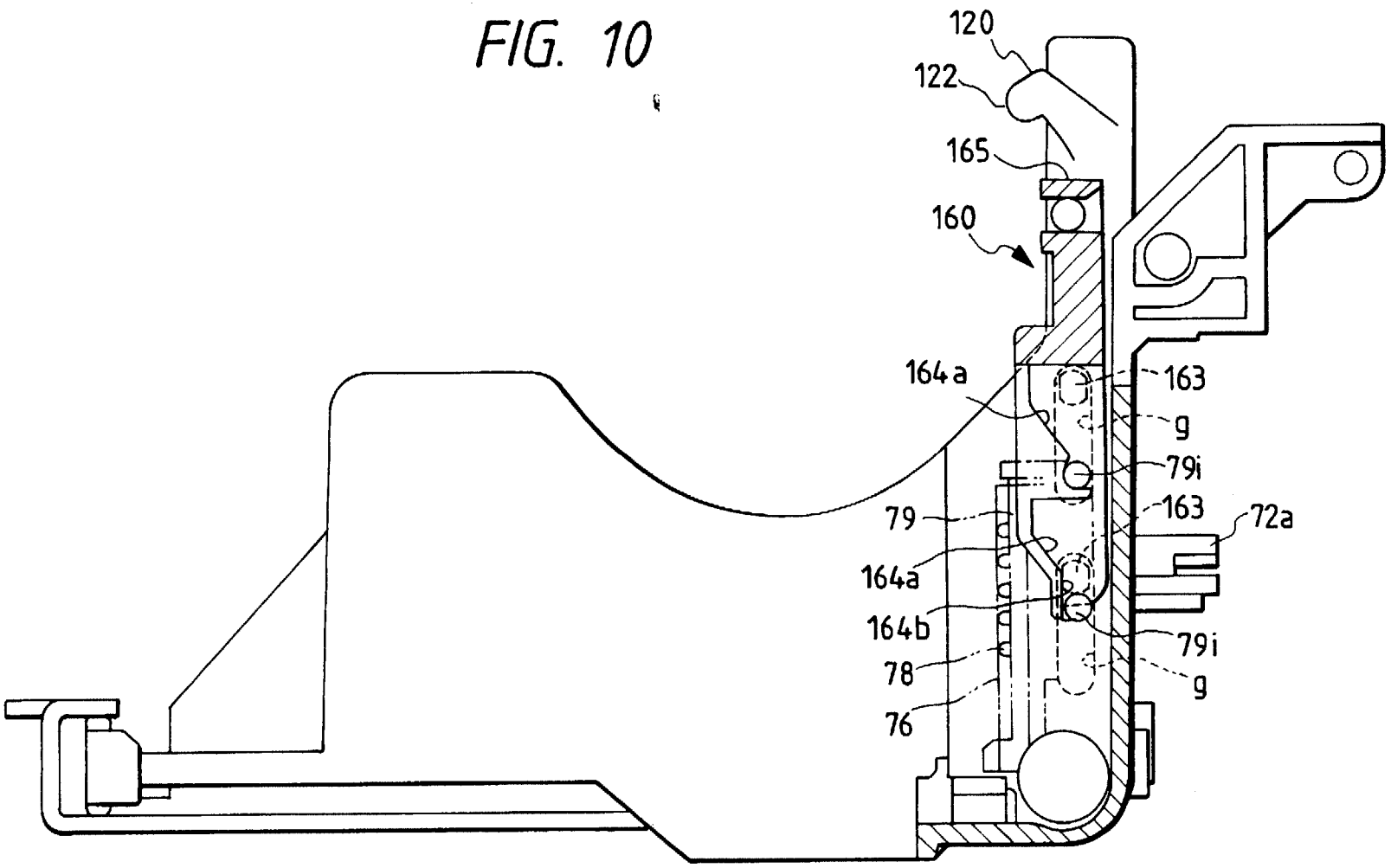

As the unit pressing lever 120 is turned in the above-described manner, as shown in FIG. 10, the plate cam 160 is moved upwardly, so that the cam surfaces 164 abut against the pins 79*i* of the pad holder 79, thus pushing the pins 79*i* to the right in FIG. 10. As a result, the pad holder 79 is moved to the right in FIG. 4 against the elastic force of the compression spring 77. In this operation, since the inclined surfaces 164*a* of the cam surfaces 164 are equal in the angle of inclination to one another, the pad holder 79 is retracted in the direction which is perpendicular to the contact surfaces of the first and second electrical connecting sections 76 and 622 while maintaining those electrical connecting sections in parallel with each other.

Hence, in removing the unit 60, the first electrical connecting section 76 on the side of the carriage, and the second electrical connecting section 622 on the side of the unit 60 are loosened from each other. Therefore, in this case, those electrical connecting sections 76 and 622 are prevented from being roughly rubbed by each other, or from being damaged.

In the case where, under the condition shown in FIG. 10, the unit 60 is mounted again, the pad holder 79 has been retracted to the right. Hence, the unit 60 can be smoothly and readily mounted on the carriage 70, with the first and second electrical connecting sections 76 and 622 not being rubbed by each other. Thereafter, the operating lever 110 is turned. As a result, the unit pressing lever 120 is also turned to fix the unit 60, and the hook 113 is engaged with the end portion 134 of the first link 130, whereby the unit is fixedly secured thereto.

As the unit pressing lever 120 is turned, the plate cam 160 is moved downwardly, so that its cam surfaces 164 are disengaged from the pins 79*i* of the pad holder 79. Hence, the pad holder 79 pushes the first electrical connecting section 76 against the second electrical connecting section 622 of the unit 60 through the pad 78 with the aid of the compression spring 77. In the case where the cam surfaces 164 of the plate cam 160 are disengaged from the pins 79*i* of the pad holder 79, as was described above, the pins 79*i* are caused to slide down the inclined surfaces 164*a*. Hence, the pad holder 79 gradually pushes the first electrical connecting section 76 against the second electrical connecting section 622 while maintaining those electrical connecting sections in parallel with each other. Thus, the mounting of the unit 60 is free from a difficulty that, for instance, the meniscuses formed at the ends of the nozzles of the head section 61 are broken by impact.

The unit 60 will be described in more detail.

As was described above, the ink jet type recording unit 60 is detachably mounted on the carriage 70. An ink jet type recording unit 60 to be mounted thereon is selected according to whether a monochromatic printing operation is carried out or whether a color printing operation is carried out. The ink jet type recording unit 60 mounted on the carriage 70 receives drive signals through the FPC 76' which has its one end connected to recording head driving means (not shown), and the other end secured to the carriage 70.

In FIG. 11, reference numeral 19 designates capping means for sealing the recording head when the printer is not in use.

FIGS. 12 through 15 show an example of the ink jet type recording unit 60, which constitutes one of the specific features of the invention. In those figures, reference numeral 62 designates a casing which forms a recording unit body. The casing 62 is a container which provides an ink cartridge accommodating chamber 611 adapted to accommodate an ink cartridge 50. An ink jet type recording head 612 is provided on the bottom of the casing which is opposite to a member 64*c*. The casing has a window 610*b* in its wall (the front wall 610*d* in the embodiment) so that the quantity of ink in the ink cartridge 50 can be visually detected.

The casing 62 has an ink cartridge fixing lever 613 along its one upper edge. The lever 613 is used to push the ink cartridge 50 into the ink cartridge accommodating chamber 611, to fix the ink cartridge 50 in the chamber 611, and to pull the ink cartridge 50 out of the chamber 611.

The end portion (on the side of the timing belt 17) of the ink cartridge fixing lever 613 is coupled to the casing 62 through a pair of shafts 614 and 614 so that, the lever 613 is coupled to the casing 62 to be swingable about the shafts 614 and 614. In addition, the lever 613 has a pair of side pieces 613*a* on its both sides which cover two opposite side walls of the casing 62.

The side pieces 613*a* have engaging holes 613*b*, respectively. The two opposite side walls of the casing 62 have locking pieces 610*a* in correspondence to the engaging holes 613*b* of the side pieces 613*a* so as to prevent the ink cartridge fixing lever 613 from opening due to vibrations or the like.

Ink supplying needles 615, 616 and 617 are embedded in the bottom of the head section 61 which are inserted into the ink supplying outlets 55 of the ink cartridge 50, whereby inks are supplied to the recording head 612 through flow paths 618, 619 and 610 provided in a head casing 621 (described later).

Figure 13:
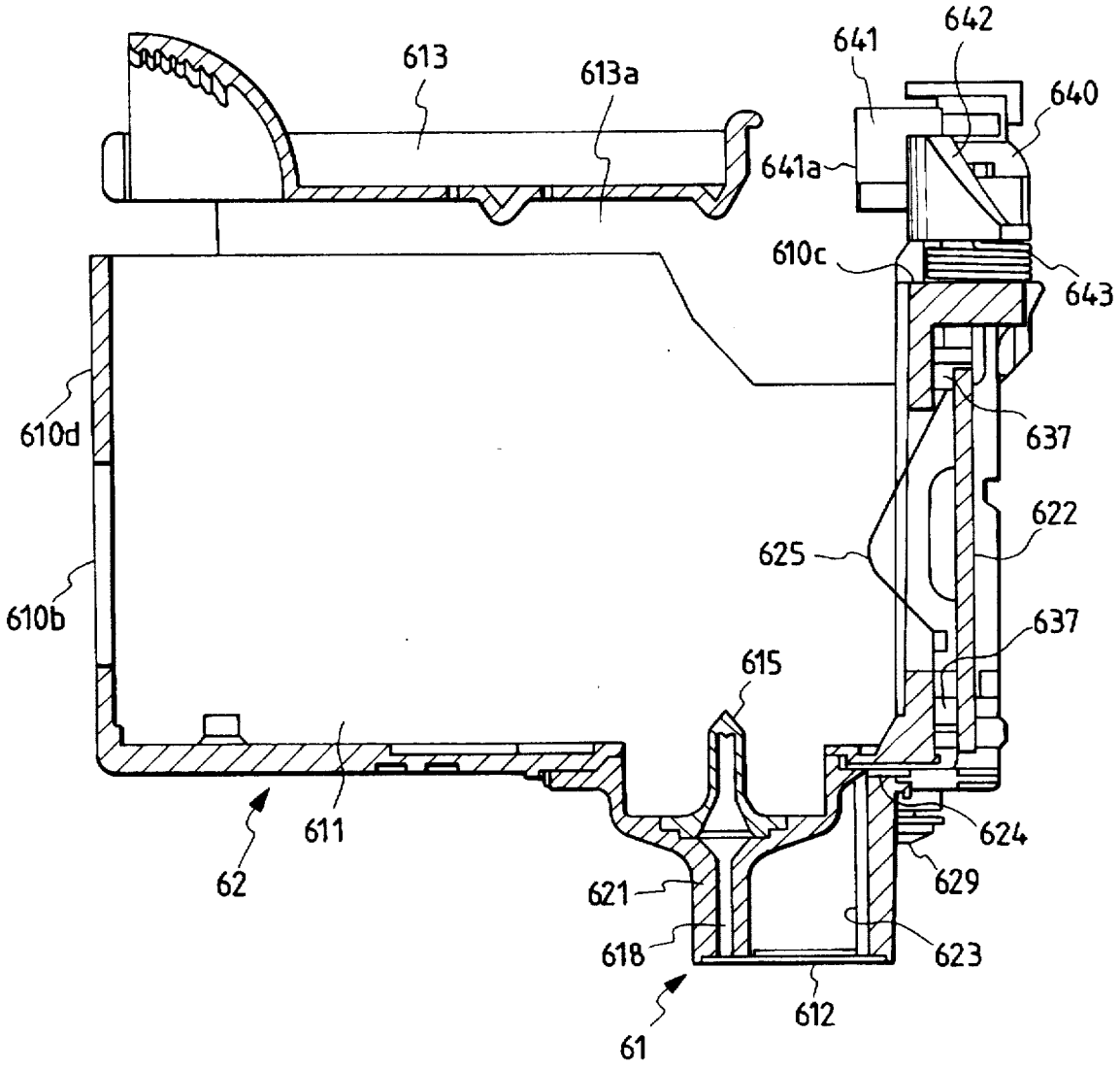
FIG. 13 is a sectional view taken along line 13—13 in FIG. 12.
Figure 14:
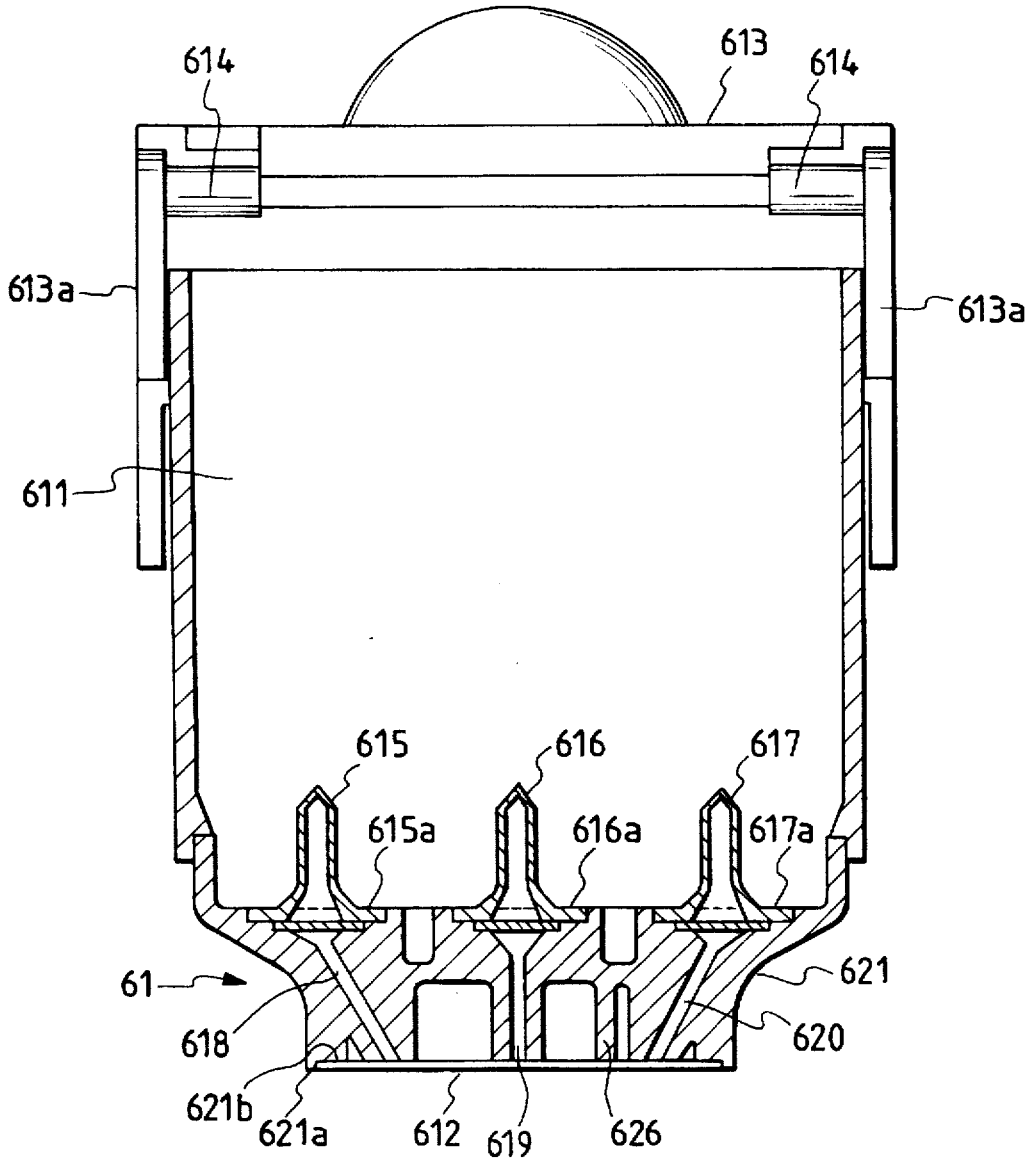
FIG. 14 is a sectional view taken along line 14—14 in FIG. 12.
Figure 15:
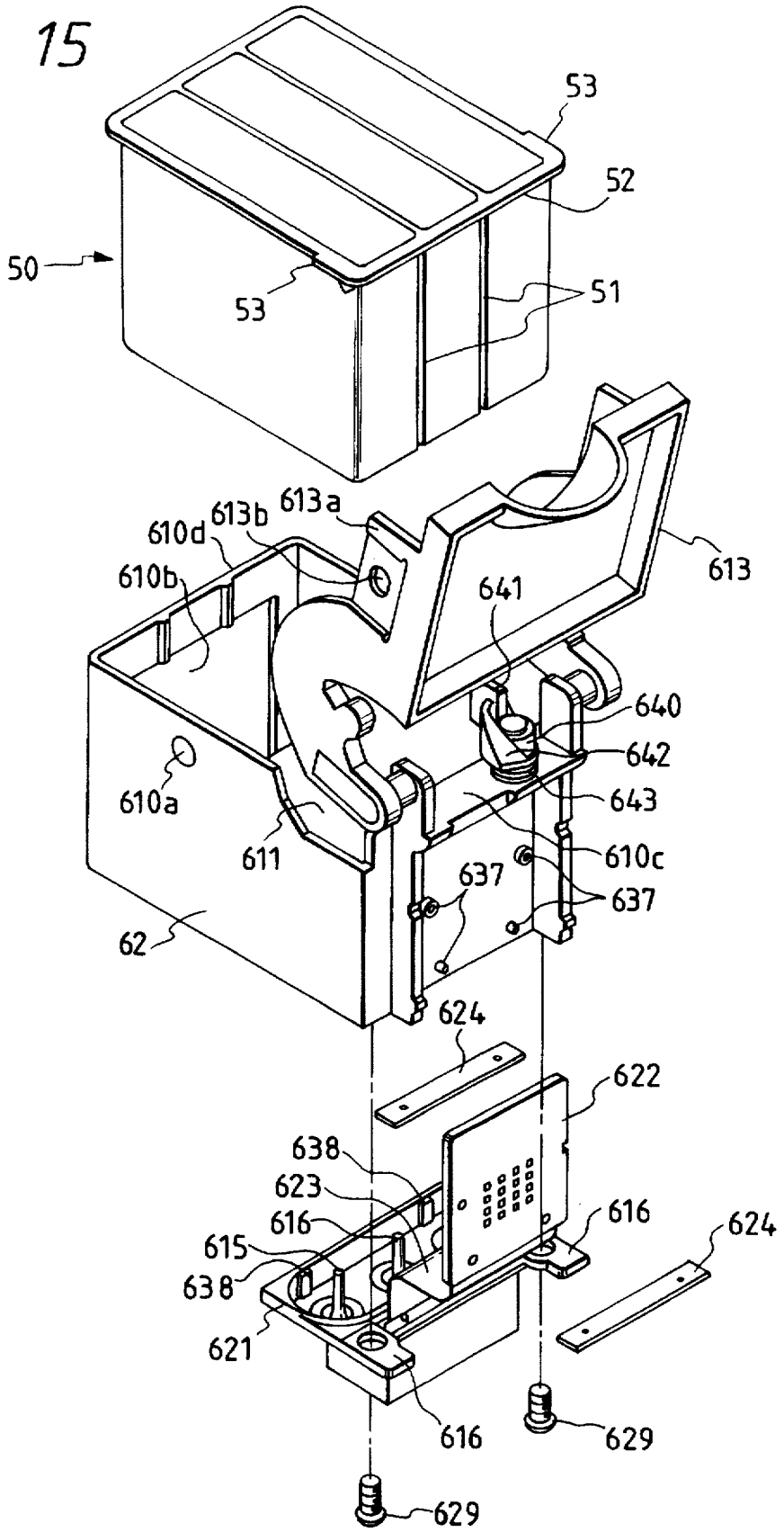
FIG. 15 is an exploded perspective view of the color printing ink jet type recording unit according to the invention.

The recording unit has a circuit board 622 on its one side which becomes the rear side when the recording unit is mounted on the carriage 70 (or on its right side in FIG. 13). The circuit board 622 has a drive circuit for driving the recording head 612, and it is connected to the latter 612 through an FPC 623.

In FIGS. 12 through 15, reference numeral 621 designates a head casing. The head casing 621 is formed by injection-molding a macromolecular material such as a cyclic olefin copolymer (whose trade name is "Apel(phonetic)") which sufficiently withstands ink solvent, and is high in gas barrier characteristic, in injection molding characteristic, in thermal fusing characteristic, and in adhesive characteristic. The base portions 615*a*, 616*a* and 617*a* of the ink supplying needles 615, 616 and 617 are fixedly secured by thermally welding them with ultrasonic waves in such a manner that they are communicated with flow paths 618, 619 and 620, respectively. Under this condition, the upper end portion of a flexible cable 623 (described later), both sides of which are covered with packing sheets 614 and 624, is secured to the bottom of the casing 62 with screws 629 and 629.

The head casing 621 is secured through the packing sheets 624 and 624 in the above-described manner. Hence, even if, when the ink cartridge is loaded or unloaded, the ink leaks into the gap formed between the casing 62 and the head casing 621 by the thickness of the flexible cable 623, it is blocked by the packing sheets 624 and 624 provided therein; that is, the entrance of ink into the head casing 621 is prevented. In other words, the recording unit is free from the difficulty that pigment and solvent such as water, which form the ink, stick onto fine conductive patterns provided in the recording head 612, to short-circuit them, so that the latter 612 is made inoperative.

Figure 16:
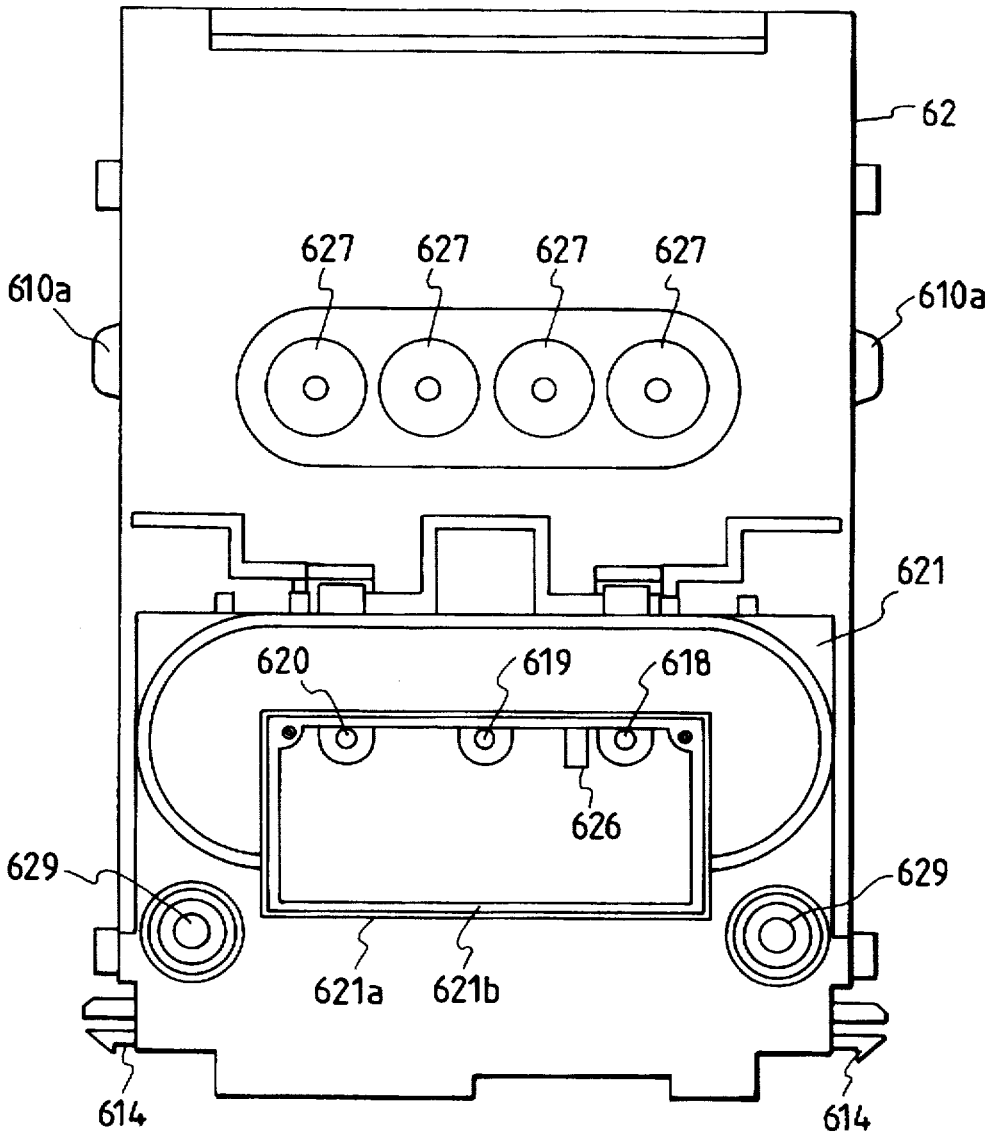
FIG. 16 is a diagram showing the structure of the bottom of the above-described recording unit.

FIG. 16 is an enlarged diagram showing one end portion of the above-described head casing 621. The head casing 621 has a stepped portion 621*b* whose outer periphery is formed into a frame 621*a*. An adhesive agent is applied to the stepped portion 621*b* so that the recording head 612 is fixedly mounted on it. The frame 621*a* eliminates the difficulty that, when a recording sheet is jammed in the printer, the recording head 612 is separated from the head casing 621 by the recording sheet thus jammed.

In FIG. 16, reference numeral 626 designates a second stepped portion which is formed slightly below the above-described stepped portion 621*b*. The second stepped portion 626 supports a tongue-shaped piece 623a (described later) of the flexible cable 623, thereby to elastically press it against a metal part of the recording head.

Further in FIG. 16, reference numeral 627 designates marking regions where results of an inspection of the ink droplet jetting operation of the recording head are recorded.

Figure 17:
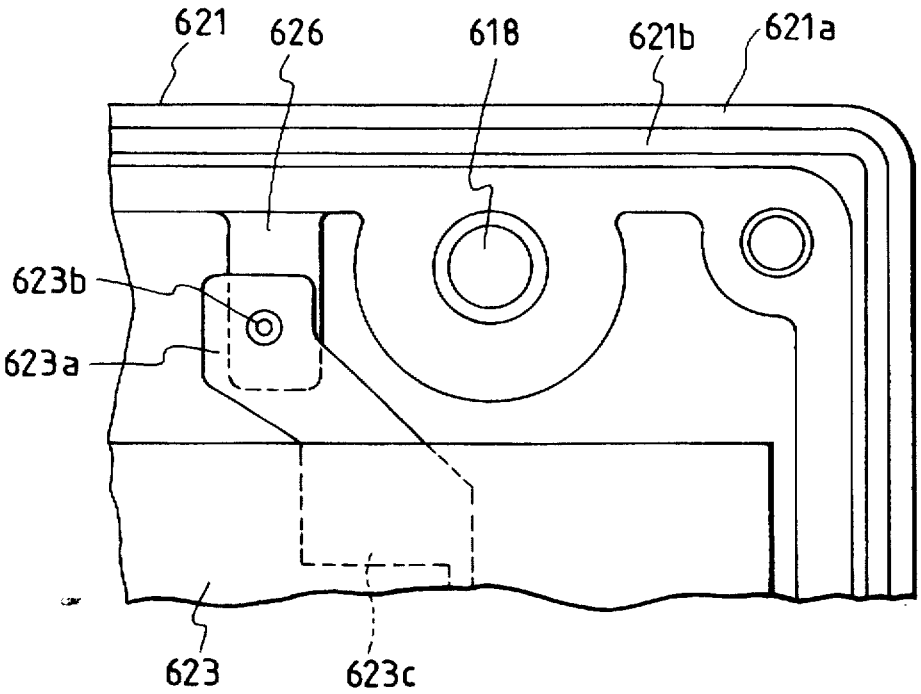
FIG. 17 is a diagram showing part of a head casing with a flexible cable.
Figure 18:
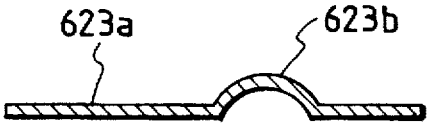
FIG. 18 is a sectional view of a tongue-shaped piece of a flexible cable.

FIG. 17 is an enlarged diagram showing the second stepped portion 626 and parts around it. In FIG. 17, reference numeral 623 designates the aforementioned flexible cable connected to the recording head 612. The tongue-shaped piece 623a of the flexible cable 623 is extended to the second stepped portion 626, and has a conductive layer which is connected to the grounding pattern of the flexible cable. In order that the tongue-shaped piece 623a is positively elastically abutted against the metal part of the recording head 612 through the second stepped portion 626, the tongue-shaped piece 623a, as shown in FIG. 18, has a dimple 623b which is curved towards the recording head.

Figure 19A:
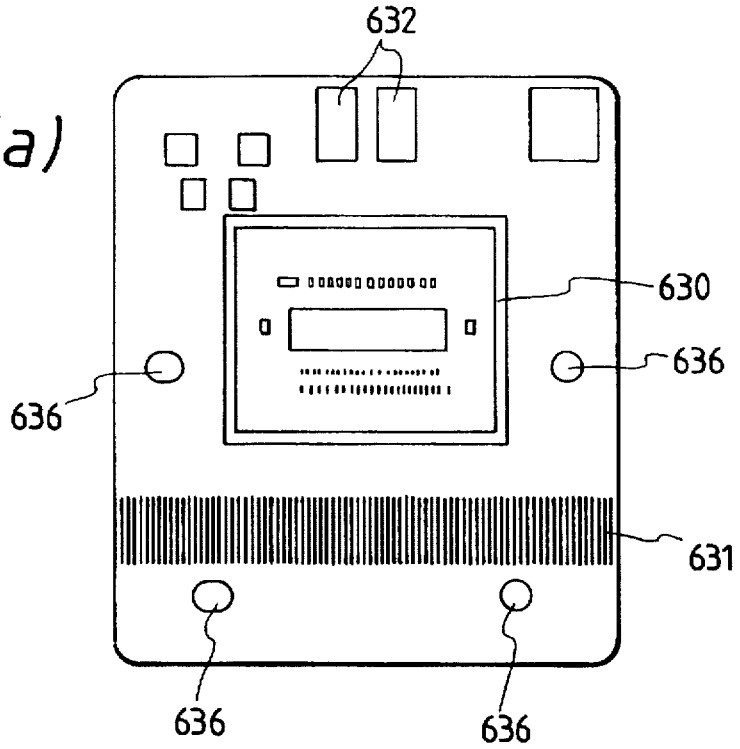
FIGS. 19(*a*) and 19(*b*) are diagrams showing an example of a circuit board mounted on a recording unit.
Figure 19B:
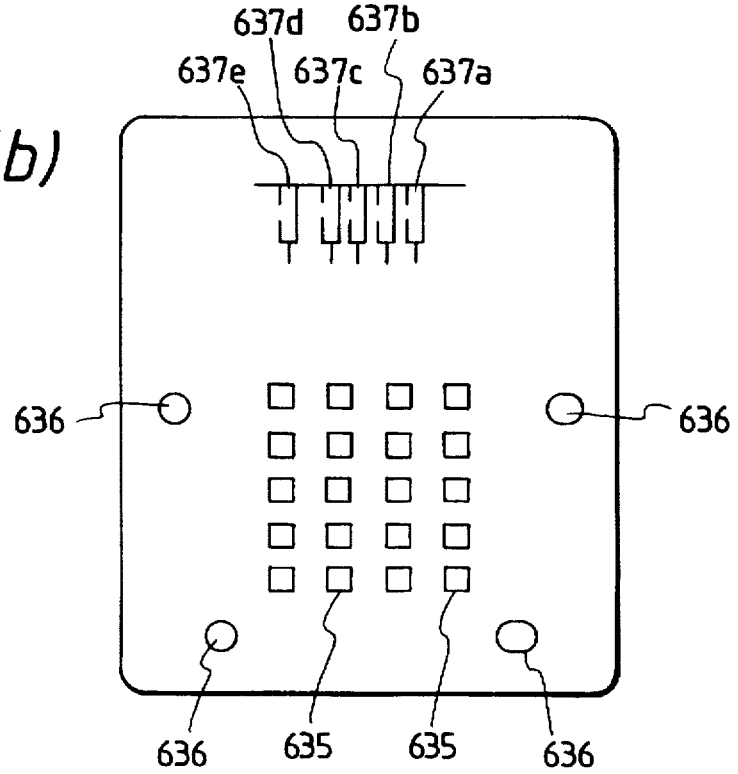

FIG. 19 shows an example of the circuit board 622. A hybrid type integrated circuit 630 is formed as a drive circuit on the rear surface (see FIG. 19(a)) of the circuit board 622 which is confronted with the ink cartridge. In addition, terminal patterns 631, and detection patterns 632 are formed on the rear surface of the circuit board 622. The terminal patterns 631 are connected to the flexible cable 623, and the detecting patterns 632 are brought into contact with ink cartridge detecting pieces 625 (see FIG. 24). On the other hand, contact patterns 635, which are brought into contact with the first electrical connecting section 76 of the carriage 70, are formed on the front surface (see FIG. 19(b)) of the circuit board 622. Further in FIG. 19, reference characters 637a, 637b, 637c and 637d designate drive voltage setting conductive patterns; and 637e, a conductive pattern for choosing between a monochromatic printing mode and a color printing mode. Further in FIG. 19, reference numeral 636 denotes engaging holes which are engaged with protrusions 637 formed on the casing 62.

When the unit is assembled, its ink discharging quantity is detected. And, in order to set a drive voltage corresponding to the most suitable ink discharging quantity, the conductive patterns are cut in such a manner that at least one of the conductive patterns should be maintained conductive. Hence, the recording apparatus body can automatically set the drive voltage by detecting the conductive pattern. When the conductive state is not detected, it is determined that no recording unit is mounted yet.

In addition, the recording apparatus body determines from the conductive pattern 637e cut that a color printing recording unit has been loaded, and determines from the conductive pattern 637e not cut that a monochromatic printing recording unit has been loaded.

On the other hand, annular protrusions 618a, 619a and 620a are formed near the base portions 615a, 616a and 617a (see FIG. 14) of the ink supplying needles 615, 616 and 617 in such a manner as to surround the outer peripheries of the lower end portions 57a of the packings 57 provided for the ink supplying outlets 55 of the ink cartridge 50, respectively. Hence, even if the ink leaks out during loading or unloading of the ink cartridge 50, it is held inside those annular protrusions 618a, 619a and 620a (see FIG. 24).

Figure 20A:
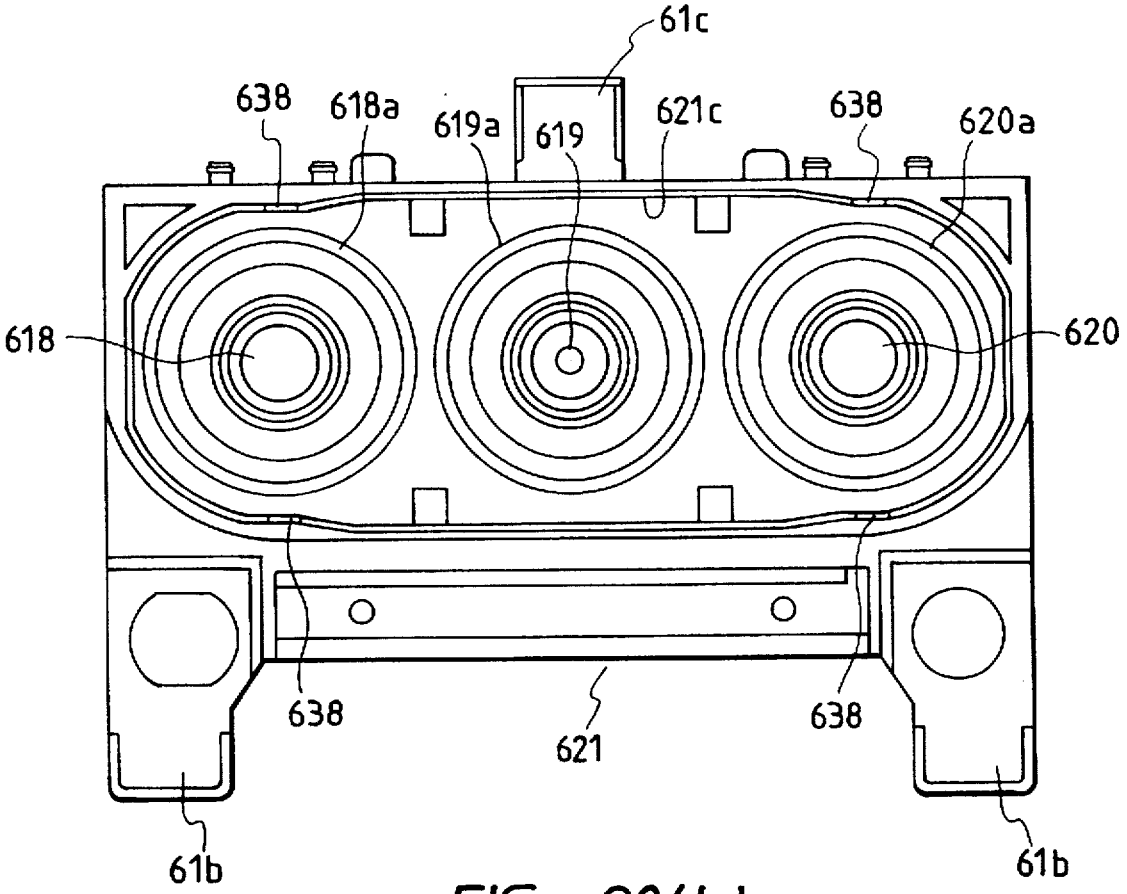
FIGS. 20(*a*) and 20(*b*) are a plan view and a sectional view, respectively, showing the arrangement of ink supplying needles and their relevant components in a head casing.
Figure 20B:
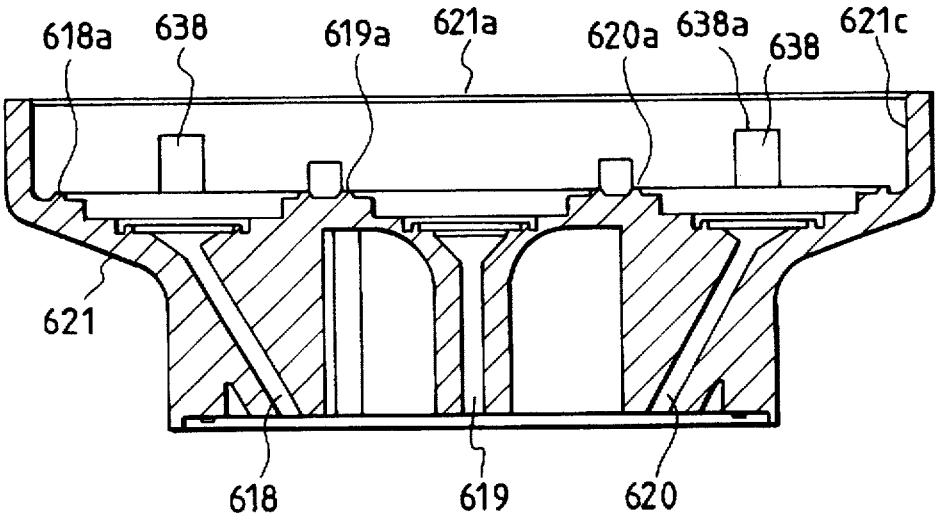

As shown in FIGS. 20(a) and 20(b), four ribs 638, 638, 638 and 638 are formed near the four corners of the head section 621 in such a manner that their bottom portions are slightly protruded inwardly from a peripheral wall 621c, and their upper ends 638a are located below a frame 621a which forms the upper portion of the head casing 621, and that both side surfaces of each of the ribs merge smoothly with the peripheral wall 621c.

Those ribs 638 function as follows: That is, when the ink cartridge 50 is inserted into the casing 62, the ribs 638 are abutted against the bottom of the ink cartridge 50, thus positioning the latter 50. As was described above, the side surfaces of the ribs are in smooth contact with the wall 621c, and the upper ends 638a are located below the frame 621a. This feature prevents the ink from rising by capillary action.

Referring back to FIGS. 12 through 15, reference numeral 640 designates an ink cartridge locking member mounted on an upper end portion 610c of the casing 62. The latter 640 has a protruded piece 641 which is substantially flush with the upper surface of the ink cartridge, and a spirally inclined surface 642 which is confronted with the protrusion 122 of the unit pressing lever 120 (FIG. 22) of the unit mounting mechanism 100. The protruded piece 641 is kept urged towards the ink cartridge 50 by a torsion coil spring 643.

The protruded piece 641 of the ink cartridge locking member has an end portion 641a whose thickness is so determined that it can be fitted in a groove 51 formed in the outer surface of the ink cartridge 50. And the height of the protruded piece 641 is so determined that, when the protruded piece 641 is abutted against the rib 52 of the ink cartridge 50, the ink supplying needles 615, 616 and 617 are spaced from the ink supplying outlets 55. Hence, the printer is free from the difficulty that the seals 56 of the ink supplying outlets 55 are damaged by the careless insertion of the ink cartridge 50 into the casing 62.

Figure 21:
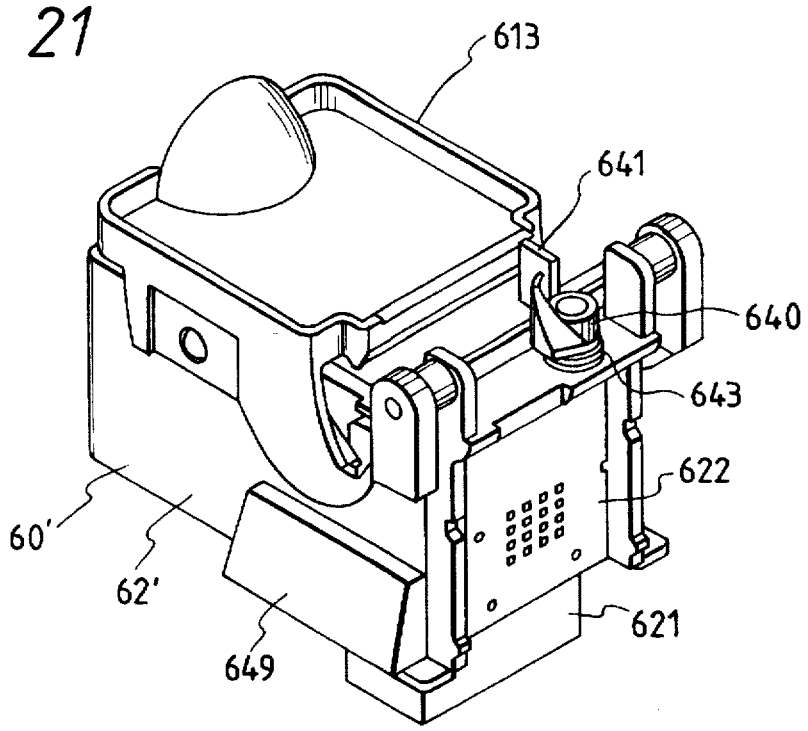
FIG. 21 is a perspective view showing an example of a monochromatic printing ink jet type recording unit according to the invention.
Figure 23:
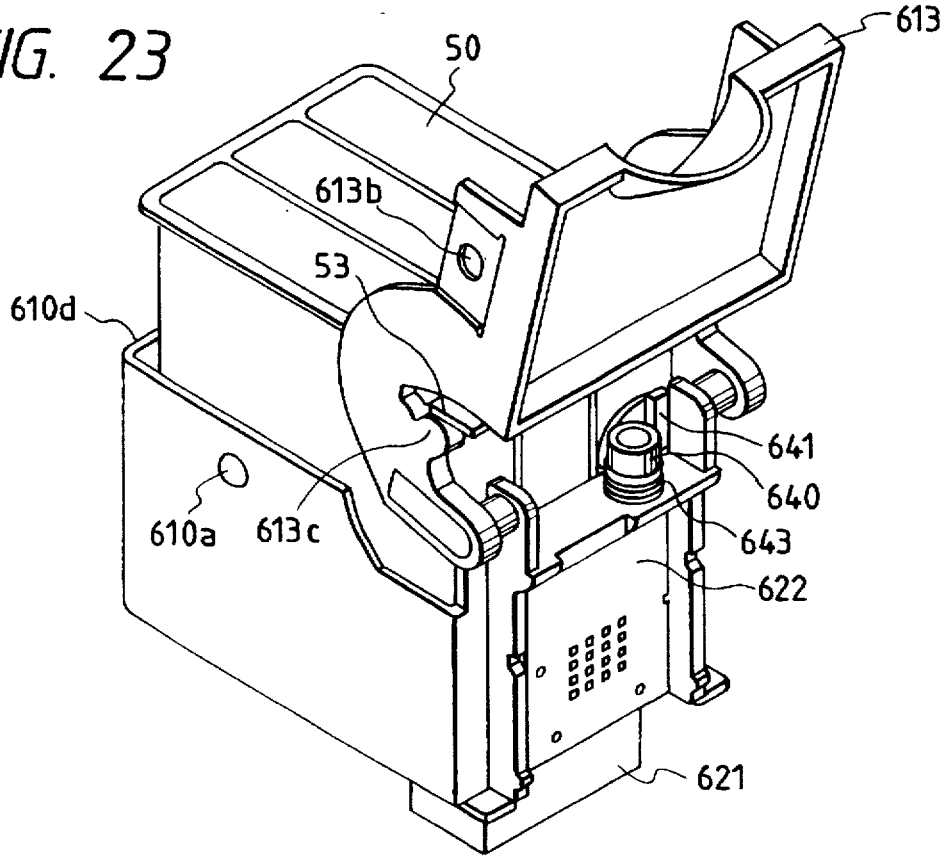
FIG. 23 is a perspective view showing the position of an ink cartridge locking member in the case where an ink cartridge is loaded with the recording unit mounted on the carriage.

The above-described recording unit is for a color printing operation. The monochromatic printing recording unit is substantially equal in construction to the color printing recording unit. In the case of the monochromatic printing recording unit, the ink cartridge may be decreased in size. In this case, as shown in FIG. 21, a protrusion 649 is formed on the bottom of a casing 62' so as to fill the gap between the carriage 70 and the casing 62' thereby to set the latter in place.

Figure 22:
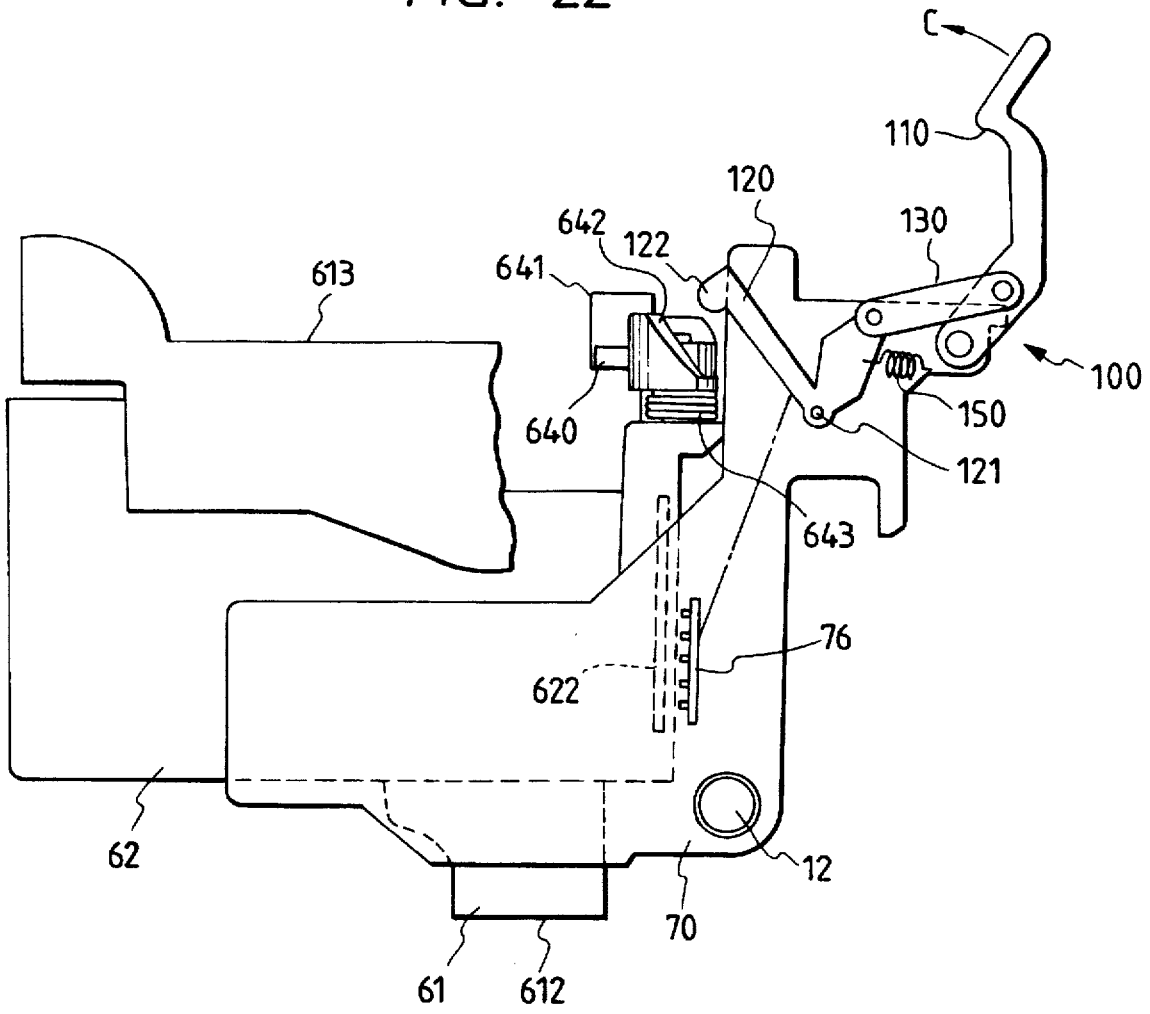
FIG. 22 is a diagram of the mounting procedure of the recording unit on the carriage.

When, in the embodiment thus designed, the operating lever 110 is turned in the direction of the arrow C as shown in FIG. 22 with the casing 62 of the recording unit 60 positioned on the carriage 70, then the unit pressing lever 120 is turned about the shaft 121, so that the protrusion 122 of the unit pressing lever 120 is moved down the spirally inclined surface 642 of the ink cartridge locking member 640 which is on the locus of the protrusion 122, while pressing the spirally inclined surface 642. As a result, the ink cartridge locking member 640 is turned about 60° against the elastic force of the torsion coil spring 643; that is, the protruded piece 641 is retracted from the ink cartridge accommodating chamber 11 (to the position indicated by the dotted line in FIG. 12). As was described before, when the operating lever 110 is turned, it is held turned by the elastic force of the spring 150.

On the other hand, as the operating lever 110 is turned, the first electrical connecting section 76 of the carriage 70 is protruded towards the casing 62 as was described before, thus being brought into contact with the contact patterns 635, 635, 635, . . . of the circuit board 622. As a result, the circuit board 622 of the unit 60 is connected through the flexible cable 76 to the control means of the printer body.

Thus, the unit can be operated with the drive voltage which has been set by the patterns 637a through 637d of the circuit board 622. And it is determined from the conductive pattern 637e whether a monochromatic printing recording unit is loaded or whether a color printing recording unit is loaded.

Under this condition, the locking pieces 610*a* are disengaged from the engaging holes 613*b*, and then the ink cartridge fixing lever 613 is pulled upwardly, so that the ink cartridge accommodating chamber 611 is opened upwardly. When, under this condition, the ink cartridge 50 is inserted into the ink cartridge accommodating chamber 622, the side ribs 53 and 53 of the ink cartridge 50 are engaged with the front protrusions 613*c* of the ink cartridge fixing lever 613. That is, the ink cartridge 50 is supported by the protrusions 613*c* and the front wall 610*d* of the casing, thus being spaced from the ink supplying needles 615 through 617.

Figure 24:
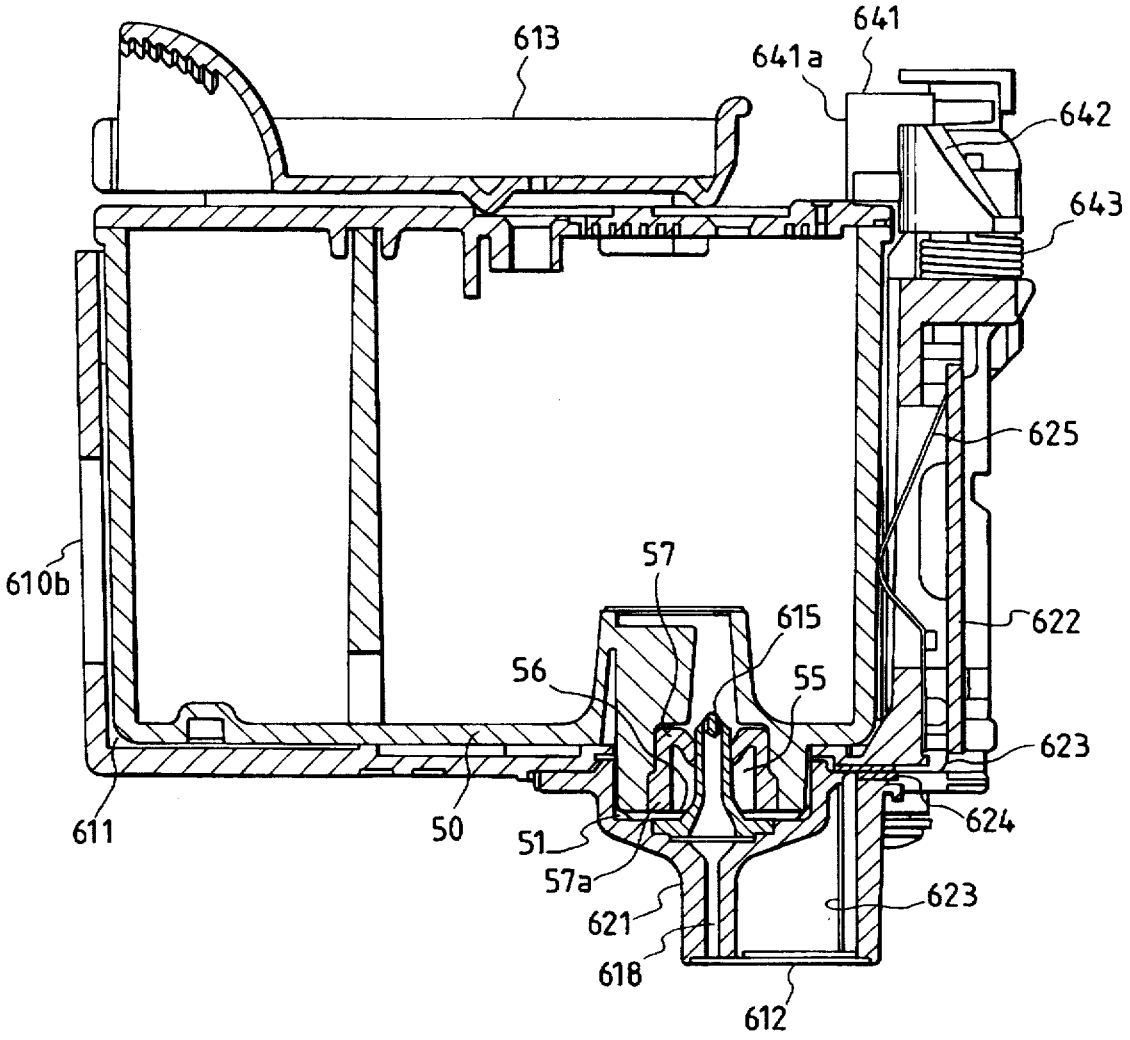
FIG. 24 is a sectional view showing the connection of the ink cartridge and the recording unit under the condition that the ink cartridge locking member inhibits the loading and unloading of the ink cartridge.

Under this condition, the lever 613 is pushed downwardly. In this case, the protruded piece 641 of the ink cartridge locking member 640 has been retracted from the cartridge accommodating chamber 611. Therefore, as the lever 613 is moved downwardly, the ink cartridge 50 is pushed downwardly so that, as shown in FIG. 24 the ink supplying needles 615, 616 and 617 are engaged with the ink supplying outlets 55 while breaking the seals 56 of the latter 55. (FIG. 24 shows the protruded piece 641 which is protruded towards the accommodating chamber 611 with the recording unit unloaded from the carriage.)

At the same time, the ink cartridge detecting piece 625, being elastically pushed towards the circuit board 622 by the ink cartridge 50, is brought into contact with the detecting patterns 632, so that the loading of the ink cartridge 50 is detected.

In the case where the ink in the ink cartridge 50 is used up by printing, the ink cartridge fixing lever 613 is turned by raising its one end portion with the recording unit 60 held on the carriage 70, so that the side ribs 53 and 53 of the ink cartridge 50 are engaged with the protrusions 613*c* of the lever 613. Hence, the ink cartridge 50 is pulled upwardly by turning the lever 613, thus being disengaged from the ink supplying needles 615, 616 and 617.

With the lever 613 pulled up to its top dead point, the ink cartridge 50 is removed out of the casing. Thereafter, a new ink cartridge 50 is inserted into the casing. In this case, the ink cartridge locking member 640 has been turned about 60°; that is, its protruded piece 641 has been retracted from the ink cartridge accommodating chamber 611 (as indicated by the dotted line in FIG. 12). Therefore, the ink cartridge 50 is set by pushing the lever 613 downwardly.

When the old ink cartridge 50 is removed from the casing, the ink cartridge detecting piece 625 is disengaged from the detecting patterns 632; and when the new ink cartridge 50 is set in the casing, the ink cartridge detecting piece 625 is engaged with the detecting patterns 632. This fact allows the control unit of the printer body to determine whether the ink cartridge 50 is removed from the casing, or whether a new ink cartridge 50 is set in the latter.

Upon completion of the replacement of the ink cartridge 50, the control means in the printer body operates to move the carriage 70 above capping means 19 to allow the latter to perform a capping operation, and to apply negative pressure to the recording head 612 to suck the ink from the ink cartridge 50 so that the recording head 612 is filled with the ink thus sucked while the bubbles are removed from the recording head 612.

When, on the other hand, in order to change the printing color, the operating lever 110 (cf. FIG. 22) is raised, as was described before, the casing 62 is unfastened from the carriage 70, and at the same time the first electrical connecting section 76 is retracted. As a result, the casing 62 is completely released from the carriage 70.

Under this condition, the casing 62 together with the ink cartridge is removed from the carriage 70, and another recording unit is set. Erroneously, the operator may try to remove the ink cartridge from the carriage 70 with their fingers on the ink cartridge fixing lever 613. However, since the engaging holes 613*b* are engaged with the locking pieces 610*a* of the casing 62, the turning of the ink cartridge fixing lever 613 is inhibited; that is, the possibility that the ink cartridge 50 is carelessly taken out of the casing 62 is eliminated.

Figure 12:
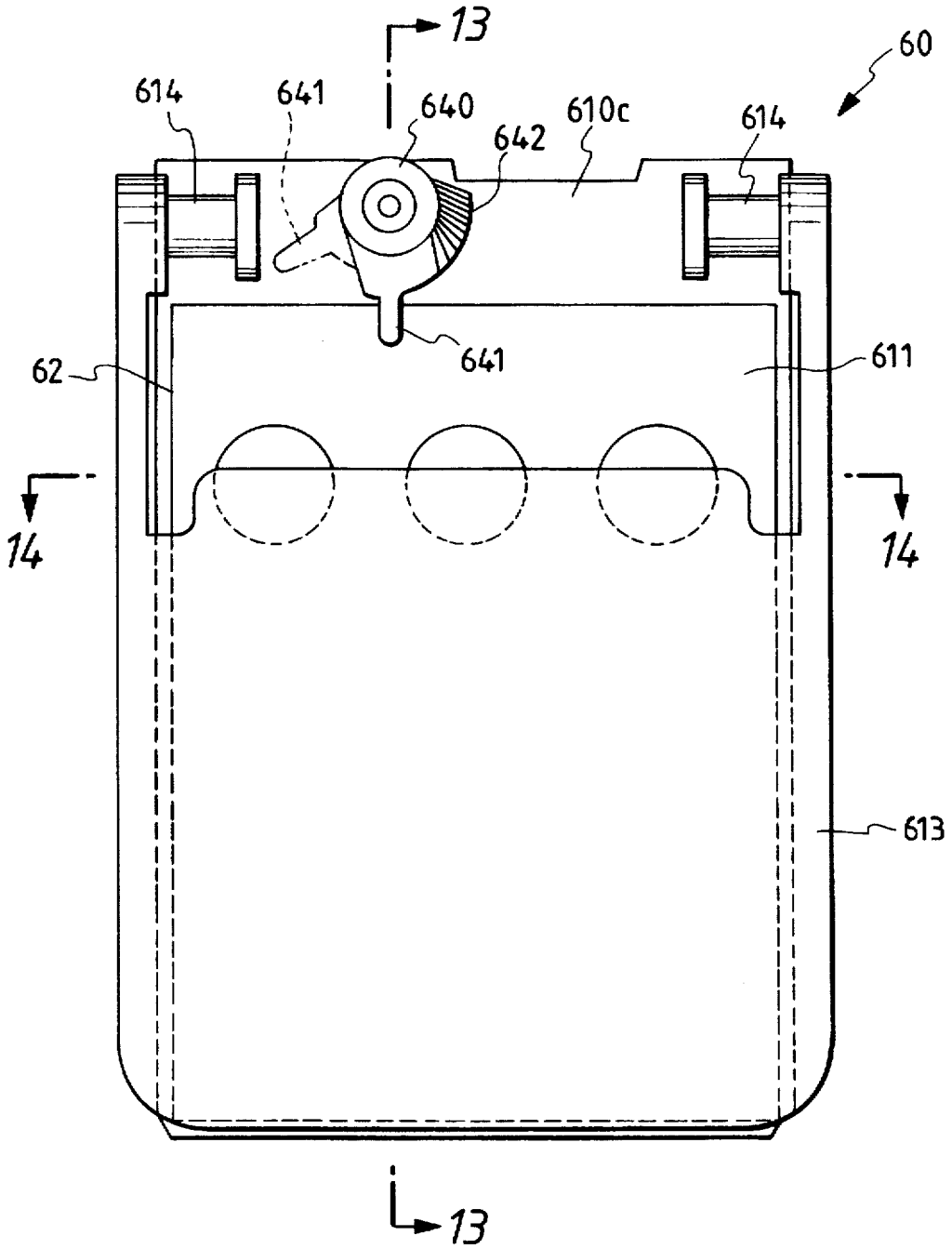
FIG. 12 is a top view of an example of a color printing ink jet type recording unit according to the invention.
Figure 25A:
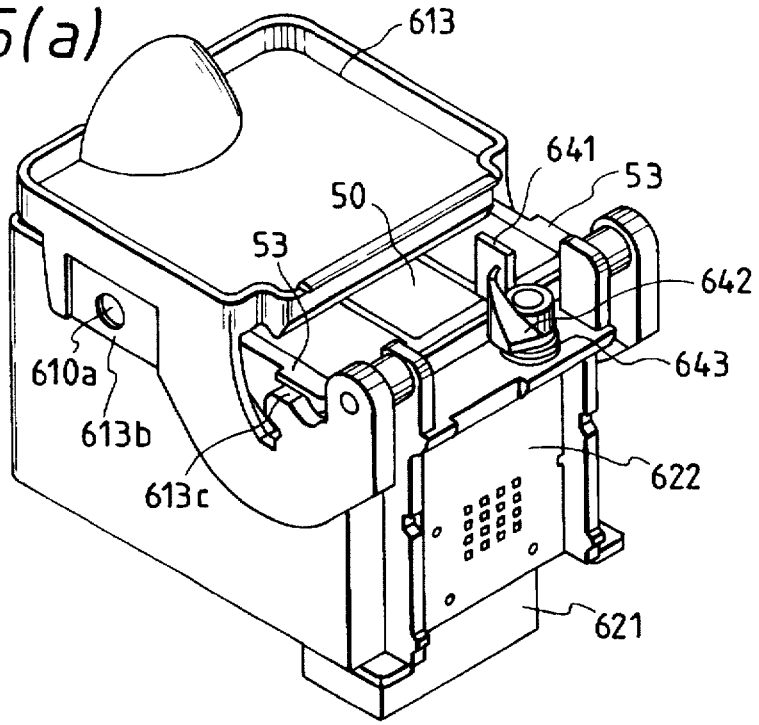
FIGS. 25(*a*) and 25(*b*) are diagrams showing the recording units removed from the carriage wherein the loading and unloading of the ink cartridge is inhibited by the ink cartridge locking member.
Figure 25B:
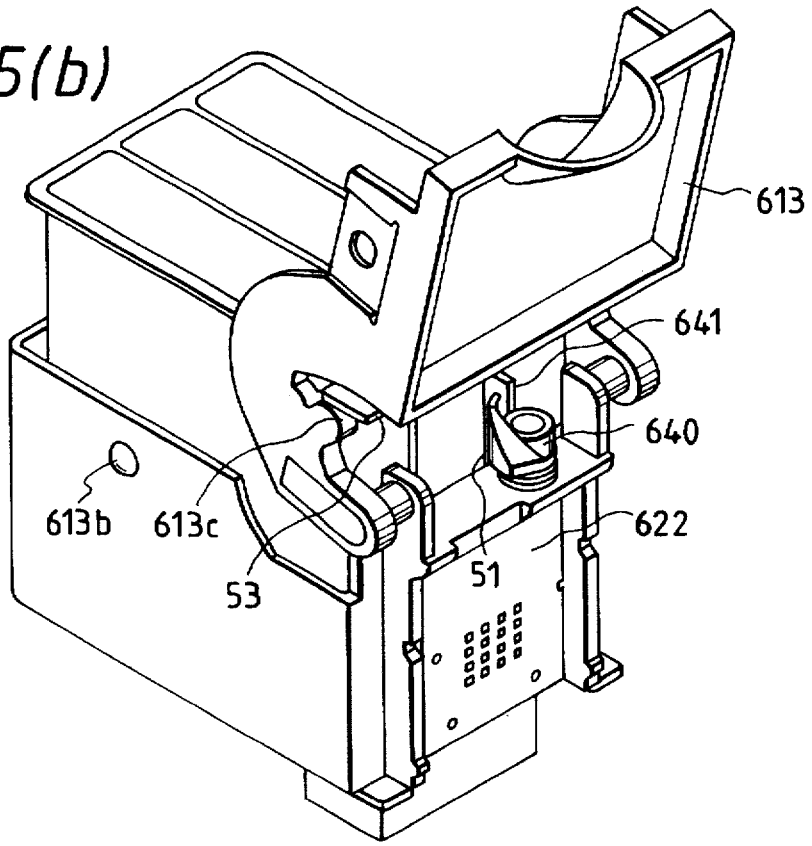

The ink cartridge locking member 640, being released from the unit pressing lever 120, is moved towards the ink cartridge accommodating chamber 611 by the elastic force of the coil spring 643, thus being placed on the upper surface of the ink cartridge 50 (as indicated by the solid lines in FIG. 12). Hence, even if it is tried to raise the ink cartridge fixing lever 613 with the engaging holes 613*a* being disengaged from the locking pieces 610*a*, the upper surface of the ink cartridge 50 abuts against the lower surface of the protruded piece 641 of the ink cartridge locking member 640 (as shown in FIG. 25(*a*)), and therefore it is impossible to raise the ink cartridge fixing lever 613 engaged therewith.

In the case where the ink cartridge has been removed from the recording head, and no ink cartridge has been loaded in the latter yet, it may be tried to load an ink cartridge therein. However, in this case, as shown in FIG. 25(*b*), the rib 52 of the ink cartridge 50 abuts against the upper end of the protruded piece 641 which is positioned on the side of the ink cartridge accommodating chamber 611, which makes it impossible to push the ink cartridge 50 into the recording head.

This prevents the ink cartridge 50 from being uselessly loaded in the casing or unloaded from the latter where, with the recording unit removed from the carriage 70, the bubbles cannot be removed therefrom. That is, the entrance of bubbles into the recording head 612 can be prevented which may occur during loading or unloading of the ink cartridge.

The recording head 60 removed from the carriage 70 is accommodated in a sealed case or the like, or at least it is capped to prevent the nozzles from being dried.

The ink jet printer thus organized has the following effects or merits:

(i) The carriage 70 is reciprocated while being guided by the guide shaft 12, and the ink jet type recording unit 60 jets printing ink to print given data on a recording sheet.

(ii) The electrical connection of the carriage 70 and the ink jet type recording unit 60 is achieved when the first electrical connecting section 76 provided for the carriage 70 and the second electrical connecting section 622 provided for the unit 60 are connected to each other under pressure.

The connection of the first and second electrical connecting sections 76 and 622 is achieved by the moving mechanism 101; that is, the latter moves the first electrical connecting section 76 towards the second electrical connecting section 622 when the ink jet type recording unit 60 is mounted on the carriage 70. Hence, the first and second electrical connecting sections 76 and 622 are connected uniformly; that is, they are positively engaged with each other.

In the case of removing the ink jet type recording unit 60 from the carriage 70, the first electrical connecting section 76 has been spaced from the second electrical connecting section 622 by the moving mechanism 101 against the elastic force of the energizing member 77. Hence, the recording unit 60 can be readily removed from the carriage 70.

In addition, in the case of mounting the recording unit 60 on the carriage 70, as was described above, the first electrical connecting section 76 has been spaced from the second electrical connecting section 622. Hence, the recording unit 60 can be mounted on the carriage 70 with ease.

That is, with the ink jet printer, the recording unit 60 can be readily mounted on and removed from the carriage 70, and can be positively electrically connected to the latter 70.

(iii) The first electrical connecting section 76 is made up of one end portion of the FPC 76', the other end portion of which is connected to the control section of the printer body, and the moving mechanism 101 has the pad 78 made of elastic material which is arranged behind the first electrical connecting member 76 and the first electrical connecting section 76 is pushed against the second electrical connecting section 622 through the pad 78. Hence, when the first electrical connecting section 76 is moved towards the second electrical connecting section 622, owing to the elastic action of the pad 78 due to the movement of the first electrical connecting section 76, those electrical connecting sections 76 and 622 are more uniformly connected to each other. The protrusions **78*a* of the pad 78 have the holes 78*d*, thus being deformable. Hence, the pad 78 follows the contacts of the first electrical connecting section 76** smoothly, which contributes to the uniform connection of the first and second electrical connecting sections.

(iv) The moving mechanism 101 has the flat-plate portion **79*a* which supports the pad 78 and is moved back and forth with respect to the second electrical connecting section. The flat-plate portion 79*a* supports the pad 78 in such a manner that the pad is slightly movable in the direction perpendicular to the direction in which the flat-plate portion is moved back and forth (or in the direction which is in parallel with the flat-plate portion). Hence, the first and second electrical connecting sections 76 and 622** are more uniformly connected to each other.

That is, the pad 78 is finely movable since it is elastically deformable. In addition, as was described above, the pad 78 is so supported that it is slightly movable in the direction perpendicular to the direction in which the flat-plate portion **79*a* is moved back and forth. Therefore, the pad thus supported is finely movable as a whole. Hence, when the first electrical connecting section 76 is pushed against the second electrical connecting section 622, the pad 78 located behind the first electrical connecting section 76** is finely moved.

This fine movement contributes to the more uniform connection of the first and second electrical connecting sections 76 and 622.

In the above-described embodiment, the pad 78 has the protrusions **78*a* which press the contacts 76*b* of the first electrical connecting section 76 from behind. The protrusions 78*a* are suitably positioned behind the contacts 76*b* because the pad 78** is finely moved as was described above. As a result, the first and second electrical connecting sections are more suitably connected to each other.

(v) The mounting mechanism 100 of the head is operated in association with the moving mechanism 101. Hence, the recording unit 60 can be more readily mounted on the carriage 70 or removed therefrom.

(vi) The guide shaft 12 and the carriage 70 are pushed against each other by the energizing member 77; that is, the former 12 and the latter 70 are snugly engaged with each other. Hence, the ink jet printer is able to provide printed sheets which are improved in quality.

The energizing member 77, which pushes the guide shaft 12 and the carriage 70 against each other, further pushes the first and second electrical connecting sections 76 and 622 against each other. This means that, in the ink jet printer, the number of energizing members is reduced.

Hence, if summarized, in the ink jet printer, the number of components is small, and the recording unit 60 is detachably mounted on the carriage 70, and the former 60 is positively electrically connected to the latter 70, and furthermore, the carriage 70 and the guide shaft 120 are engaged with each other without looseness.

(vii) The ink jet type recording unit 60 has a plurality of nozzle arrays arranged in the direction of movement of the carriage 70. Hence, the resultant print is high in resolution.

As was described above, the recording unit 60 has a plurality of nozzle arrays arranged in the direction of movement of the carriage 70. Hence, if the forward and backward movements of the carriage are unstable because of its looseness, then the resultant print is low in quality. However, in the ink jet printer of the invention, the guide shaft 12 and the carriage 70 are pushed against each other by the energizing member 77, so that there is no play between the guide shaft 12 and the carriage 70, as was described above. Hence, the resultant print is high in quality.

(viii) The ink jet printer has the monochromatic printing ink jet type recording unit 60' and the color printing ink jet type recording unit 60. With the monochromatic printing ink jet type recording unit 60' loaded in the printer, a monochromatic printing operation is carried out; and with the color printing ink jet type recording unit 60 loaded in the printer, a color printing operation is carried out.

In a color printing operation, especially in a full-color printing operation, it is necessary for the printing head to jet a red ink, a yellow ink, and a blue ink. Therefore, the color printing ink jet type recording unit 60 of the invention has three nozzle arrays NR, NY and NB, each of which has two lines of nozzles (six lines of nozzles in total).

In addition, the energizing member 77 permitting the replacement of the head is also used as play preventing means, which contributes to miniaturization of the ink jet printer.

That is, a small printer can be formed according to the invention which is able to perform both a monochromatic printing operation and a color printing operation high with high picture quality.

(ix) The carriage 70 has the positioning portions **71*f* and 74*d* which determine the mounting position of the ink jet type recording unit 60 (or 60'). The recording unit 60 (or 60') is urged towards the positioning portions 71*f* and 74*d* by the energizing member. Hence, the recording unit 60** is positioned in place at all times, and the resultant print is therefore high quality.

The energizing member may be the above-described one 77, which contributes to miniaturization of the carriage.

(x) The carriage 70 has the space S which is adjacent to both the guide shaft 12 and the ink jet type recording unit 60, and the energizing member 77 is provided in the space S. This feature also contributes to miniaturization of the ink jet printer.

(xi) The first electrical connecting section 76, the second electrical connecting section 622, the receiving portion **75*a* of the play preventing member 75 are set in the above-described space S in such a manner that they are in parallel with the guide shaft 12**. This structure makes it possible to further miniaturize the ink jet printer.

The ink jet type recording unit according to the invention has the following effects or merits:

As was described above, the ink jet type recording unit comprises:

the casing 62 which can be detachably mounted on the carriage 70 and has the ink cartridge accommodating chamber 611;

the ink jet type recording head 61 which, when the casing is mounted on the carriage, is fixed at the position where the ink jet recording head is confronted with the ink cartridge locking member 640;

the circuit board in which the circuit means for driving the recording head 612 is built, and which has contacts which are connected to the contacts of the recording apparatus body, the circuit board 622 being connected through the flexible cable 623 to the recording head, the ink supplying needles 615, 616, 617 for supplying inks from the ink cartridge 50 to the ink jet type recording head 612;

the cartridge fixing lever 613 which is swingably provided at one end of the casing 62, to load the ink cartridge 50 in the casing and unload the ink cartridge from the casing 62; and the cartridge locking member 640 which, when the ink cartridge 50 is loaded in the casing 62, is normally protruded towards the ink cartridge to prevent the ink cartridge from coming off, and, when the casing 62 is fixedly mounted on the carriage 70, is retracted so as to permit the loading and unloading of the ink cartridge.

Hence, with the recording unit 60 of the invention, the ink cartridge 50 can be replaced with another one, whereby, when removal of the air bubbles is impossible, replacement of the ink cartridge is prevented.

While there has been described in connection with the preferred embodiments of the invention, it should be noted that the invention is not limited thereto or thereby, and it will be obvious to those skilled in the art that various changes and modifications may be made therein without departing from the invention.

Figure 26:
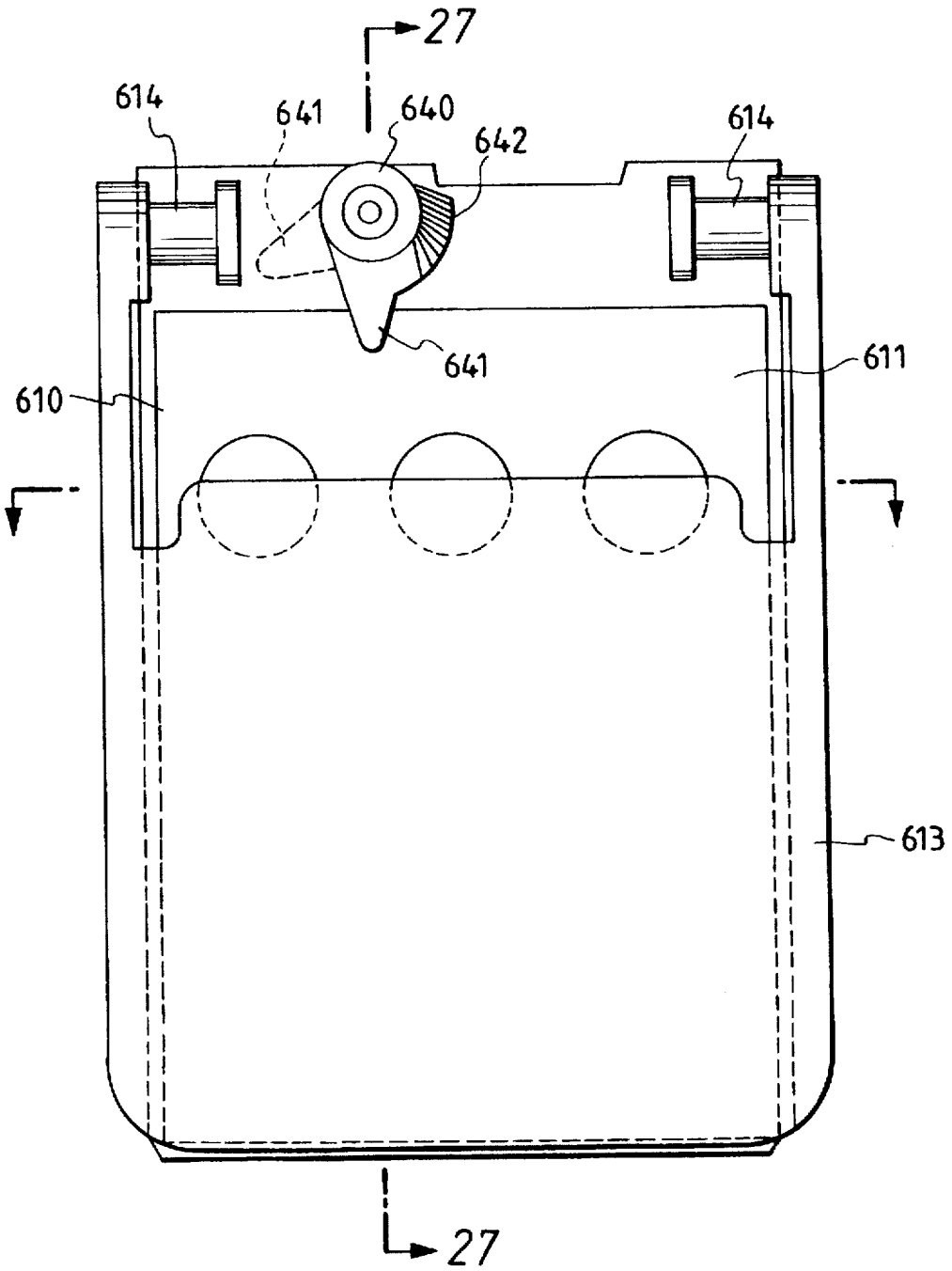
FIG. 26 is a plan view showing another example of the ink cartridge locking member.
Figure 27:
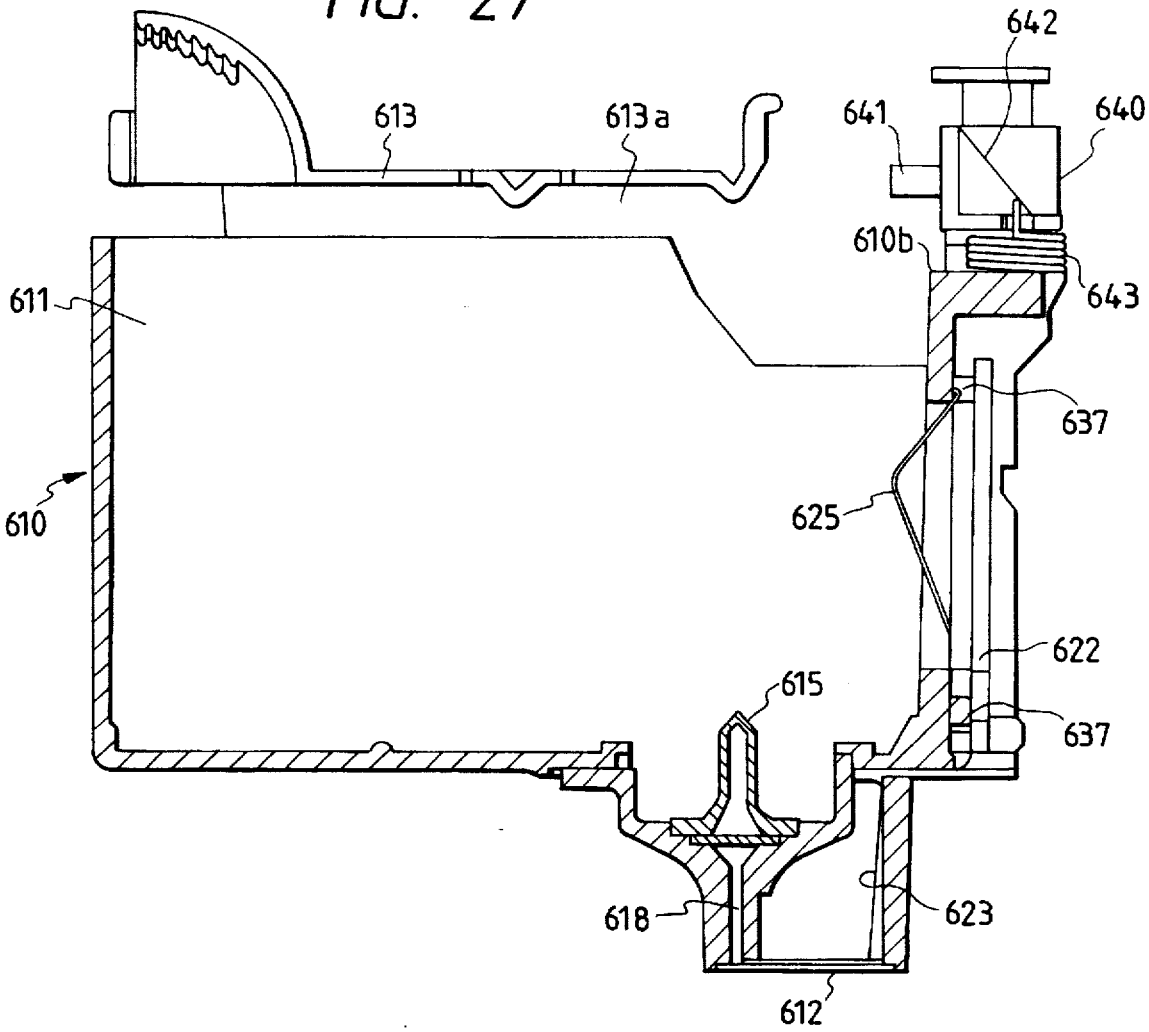
FIG. 27 is a sectional view taken along line 27—27 in FIG. 26.
Figure 28:
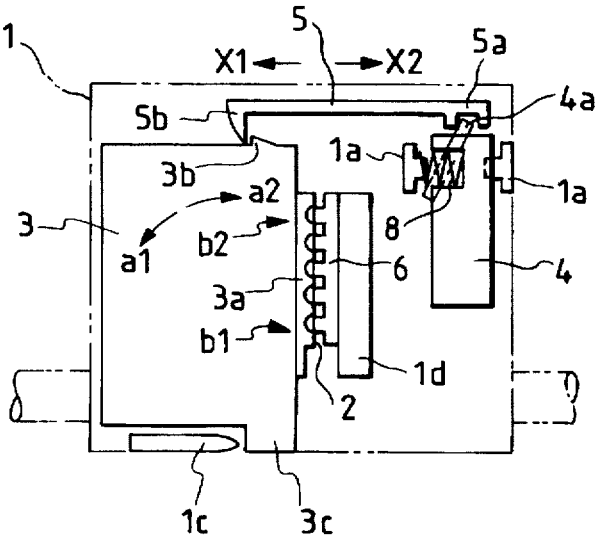
FIG. 28 is an explanatory diagram for a description of a prior art relevant to the invention.

For instance, the protruded piece 641 of the ink cartridge locking member 640 may be modified as shown in FIGS. 26 and 27.

What is claimed is:

1. An ink jet printer, characterized by comprising:

an ink jet type recording head for jetting printing ink towards a printing sheet to print given data thereon;

a carriage on which said ink jet type recording head is detachably mounted;

a substantially flat-plate-shaped first electrical connecting section provided on said carriage;

a substantially flat-plate-shaped second electrical connecting section provided on said ink jet type recording unit, so as to be connected to said first electrical connecting section under pressure;

an energizing member adapted to connect said first electrical connecting section to said second electrical connecting section under pressure; and a moving mechanism which, when said ink jet type recording unit is mounted on said carriage, moves said first electrical connecting section towards said second electrical connecting section so that said first and second electrical connecting sections are connected to each other under pressure by said energizing member, and when said ink jet type recording unit is removed from said carriage, moves said first electrical connecting section away from said second electrical connecting section against the elastic force of said energizing member.

2. An ink jet printer as claimed in claim 1, characterized in that said first electrical connecting section comprises one end portion of a flexible printed cable, the other end portion of which is connected to a control section in a printer body, and said moving mechanism has a pad made of an elastic material which is arranged behind said first electrical connecting section so that said first electrical connecting section is connected to said second electrical connecting section under pressure through said pad.

3. An ink jet printer as claimed in claim 2, characterized in that said moving mechanism has a flat-plate portion which supports said pad and is moved back and forth with respect to said second electrical connecting section, said flat-plate portion supporting said pad in such a manner that said pad is slightly movable in a direction perpendicular to the direction in which said flat-plate portion is moved back and forth.

4. An ink jet printer as claimed in claim 1, further comprising:

a mounting mechanism wherein, when said ink jet type recording unit is mounted on said carriage, fastens said ink jet type recording unit to said carriage, and when said ink jet type recording unit is removed from said carriage, unfastens said ink jet type recording unit from said carriage, and said mounting mechanism operates in association with said moving mechanism.

5. An ink jet type recording unit comprising:

a casing which can be detachably mounted on a carriage and has an ink cartridge accommodating chamber;

an ink jet type recording head which, when said casing is mounted on said carriage, is fixed at a position where said ink jet recording head is confronted with a platen;

a circuit board in which circuit means for driving said recording head is built, said circuit board having contacts which are connected to contacts provided on a recording apparatus body, said circuit board being connected through a flexible cable to said recording head, ink supplying needles for supplying inks from an ink cartridge to said ink jet type recording head;

a cartridge fixing lever which is swingably provided at one end of said casing, to load an ink cartridge in said casing and unload said ink cartridge from said casing; and a cartridge locking member which, when said ink cartridge is loaded in said casing, is normally protruded towards said ink cartridge to prevent said ink cartridge from coming off, and when said casing is fixedly mounted on said carriage, is retracted so as to permit the loading and unloading of said ink cartridge.

6. An ink jet type recording unit as claimed in claim 5, in which said cartridge fixing lever has protrusions on the side of the center of swing thereof which are engaged with the lower surfaces of ribs formed on both sides of the upper end face of said ink cartridge, and when said cartridge fixing lever is swung downwardly, said ink cartridge is pushed into said casing through the lower surface of said lever, and when said cartridge fixing lever is swung upwardly, said ink cartridge is pulled out of said casing with said protrusions engaged with said ribs.

7. An ink jet type recording unit as claimed in claim 5, wherein when said cartridge fixing member has been retracted from said ink cartridge accommodating chamber, and said ink cartridge is inserted into said casing with said cartridge fixing lever released, said ink cartridge is supported by said cartridge fixing lever and one side wall of said casing.

8. An ink jet type recording unit as claimed in claim 5, wherein said ink cartridge locking member is so positioned that, when said ink cartridge abuts against the upper surface thereof, said ink cartridge locking member holds said ink cartridge so that ink supplying outlets of said ink cartridge are spaced from said ink supplying needles.

9. An ink jet type recording unit as claimed in claim 5, wherein said carriage is so shaped as to be able to accommodate a printing unit of maximum size, and is adjusted in size so that at least the lower half of said casing conforms to the configuration of an opening of said carriage.

10. An ink jet type recording unit as claimed in claim 5, in which said ink cartridge is divided into a plurality of chambers with partition walls in which a plurality of kinds of printing inks are stored, and has a recess in an outer surface thereof which is opposed to said partition wall, and said ink cartridge locking member is engaged with said recess when protruded towards said ink cartridge accommodating chamber.

11. An ink jet type recording unit as claimed in claim 5, in which said ink jet type recording head is fixed to the lower surface of said casing through a head casing, the outer periphery of which is formed into a frame.

12. An ink jet type recording unit as claimed in claim 11, in which said casing has a window in a portion thereof which is confronted with said head casing, said ink supplying needles are embedded in said head casing, and annular protrusions, which are larger in inside diameter than ink supplying outlets, are formed around said ink supplying needles.

13. An ink jet type recording unit as claimed in claim 11, further comprising a plurality of ribs formed on the surfaces of the walls of said head casing, to position said ink cartridge.

14. An ink jet type recording unit as claimed in claim 13, in which the upper end faces of said ribs are located below said head casing, and both side surfaces of each of said ribs merge smoothly with the side surface of said head casing.

15. An ink jet type recording unit as claimed in claim 5, wherein one end portion, on the side of said ink jet type recording head, of said flexible cable has a tongue-shaped piece which is grounded, said tongue-shaped piece being elastically pressed so as to be electrically connected to a conductive part of said ink jet type recording head.

16. An ink jet type recording unit as claimed in claim 15, in which a protrusion is formed on a part of said tongue-shaped piece which is brought into contact with said recording head.

17. An ink jet type recording unit as claimed in claim 16, in which a stepped portion adapted to push said protrusion against said recording head is formed in opposition to said tongue-shaped portion.

18. An ink jet type recording unit as claimed in claim 5, in which said casing has a window through which said ink cartridge can be visually detected.

19. An ink jet type recording unit as claimed in claim 5, wherein said circuit board has a plurality of patterns which can be cut or short-circuited to set a voltage for driving said ink jet type recording head, and whether or not an ink jet type recording unit is loaded in said recording apparatus body can be detected from the form of said patterns.

20. An ink jet type recording unit as claimed in claim 5, in which said circuit board has a circuit pattern which is cut or short-circuited to indicate whether a color printing recording unit is loaded or whether a monochromatic printing recording unit is loaded.

21. An ink jet type recording unit as claimed in claim 19, wherein at least one of said plurality of patterns of said circuit board is short-circuited.

* * * * *